US009821578B2

(12) United States Patent
Sakano et al.

(10) Patent No.: US 9,821,578 B2
(45) Date of Patent: Nov. 21, 2017

(54) TAPE PRINTING APPARATUS AND TAPE PRINTING SYSTEM

(71) Applicant: Seiko Epson Corporation, Tokyo (JP)

(72) Inventors: Hideki Sakano, Matsumoto (JP); Akihiro Shintani, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/128,025

(22) PCT Filed: Mar. 19, 2015

(86) PCT No.: PCT/JP2015/001546

§ 371 (c)(1),
(2) Date: Sep. 21, 2016

(87) PCT Pub. No.: WO2015/146092

PCT Pub. Date: Oct. 1, 2015

(65) Prior Publication Data

US 2017/0120638 A1 May 4, 2017

(30) Foreign Application Priority Data

Mar. 24, 2014 (JP) ..... 2014-060914
Aug. 1, 2014 (JP) ..... 2014-157993

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 15/044; B41J 3/4075; F16D 3/28; F16D 3/62
See application file for complete search history.

(56) References Cited

U.S. PATENT DOCUMENTS 2,680,613 A * 6/1954 Williams ..... G11B 15/26 226/102
5,921,688 A * 7/1999 Furuya ..... B41J 17/32 101/288

(Continued)

FOREIGN PATENT DOCUMENTS

CN 102295197 A 12/2011
JP 2008-194916 A 2/2007

(Continued)

OTHER PUBLICATIONS

Search Report recieved in International Application No. PCT/JP2015/001546, dated Jun. 9, 2015.

*Primary Examiner* — Julian Huffman
*Assistant Examiner* — Michael Konczal
(74) *Attorney, Agent, or Firm* — ALG Intellectual Property, LLC

(57) ABSTRACT

A tape printing apparatus or the like is provided, in which both smoothness and high positioning accuracy can be realized when a tape cartridge is attached and detached. The tape printing apparatus includes a cartridge mounting portion on which a tape cartridge having a core shaft portion disposed on an inner peripheral side of a wound print tape is detachably mounted, a positioning protrusion portion which protrudes from the cartridge mounting portion and engages with an inner peripheral portion of the core shaft portion of the mounted tape cartridge, and a plurality of conductive contactors which are provided in the positioning protrusion portion, in which the plurality of conductive contactors are equally disposed in a peripheral direction in the positioning protrusion portion, and bias an inner peripheral surface of the engaged core shaft portion toward the outside in a radial direction.

12 Claims, 15 Drawing Sheets

(56) References Cited

U.S. PATENT DOCUMENTS

| | | | | |
|---|---|---|---|---|
| 7,484,902 | B2 * | 2/2009 | Pomfret | B41J 32/00 347/214 |
| 2010/0247209 | A1 * | 9/2010 | Yamaguchi | B41J 15/044 400/207 |
| 2013/0089366 | A1 | 4/2013 | Kosuge | |
| 2015/0124041 | A1 | 5/2015 | Kosuge | |
| 2016/0214416 | A1 | 7/2016 | Kosuge | |

FOREIGN PATENT DOCUMENTS

| | | | |
|---|---|---|---|
| JP | 2012126141 | A * | 7/2012 |
| JP | 2013-141749 | | 7/2013 |

* cited by examiner

TAPE PRINTING APPARATUS AND TAPE PRINTING SYSTEM

CROSS-REFERENCE TO RELATED APPLICATIONS

This application is the U.S. National Phase under 35 U.S.C. §371 of International Application No. PCT/JP2015/001546 filed on Mar. 19, 2015, which in turn claims the benefit of Japanese Application No. 2014-060914 filed on Mar. 24, 2014, and Japanese Application No. 2014-157993 filed on Aug. 1, 2014, the disclosures of which are expressly incorporated by reference herein.

TECHNICAL FIELD

The present invention relates to a tape printing apparatus and a tape printing system including a cartridge mounting portion on which a tape cartridge is detachably mounted.

BACKGROUND ART

In the related art, as this kind of tape printing apparatus, a print label preparation apparatus including a cassette mounting portion is known (refer to JP-2013-141749).

In the cassette mounting portion, a transport mechanism or a printing mechanism which performs printing on a tape discharged from a tape cassette is disposed, and two positioning pins which are disposed to be separated from each other uprightly stand. In the cassette mounting portion, a rectangular column-shaped sensor support portion into which a plurality of sensors for detecting attribute information of the tape (film tape) are incorporated uprightly stands. In the sensor support portion, four reflection type sensors arranged vertically are provided on the front surface of the sensor support portion, and similarly, four reflection type sensors arranged vertically are provided on the right surface thereof.

Meanwhile, the tape cassette includes an adhesive tape spool around which a double-sided adhesive tape is wound, a film tape spool around which a film tape (print tape) is wound, a ribbon spool around which an ink ribbon is wound, a ribbon winding spool which winds the ink ribbon, a tape driving roller, and a cassette case in which the above-described components are accommodated. In the cassette case, two pin holes corresponding to the two positioning pins are provided, and a recessed space corresponding to the sensor support portion is formed in a space between the double-sided adhesive tape and the film tape. In a peripheral wall portion configuring the recessed space, a total of eight black-painted detection objects corresponding to the reflection type sensors are provided. If the tape cassette is mounted on the cassette mounting portion, the two pin holes are inserted into the two positioning pins to position the tape cassette, and detection objects provided in the recessed space face the reflection type sensors.

SUMMARY

In the print label preparation apparatus of the related art, since the two pin holes corresponding to the two positioning pins and the recessed space corresponding to the sensor support portion are positioned away from each other, there is a concern that subtle positional deviation of the recessed space with respect to the sensor support portion may occur when the tape cassette is mounted. Accordingly, there is a problem that detection of the attribute information with respect to the film tape is unstable.

In order to accurately position the tape cassette, mutual positions of the two positioning pins, and the positions between the two positioning pins and the two pin holes and sizes thereof are required to be accurately determined and formed. However, if the positioning pins and pin holes are accurately formed, a friction resistance increases when the tape cassette is attached and detached, and there is a problem that attachment and detachment thereof are difficult.

An object of the present invention is to provide a tape printing apparatus and a tape printing system in which both smoothness and appropriate positioning accuracy can be realized when the tape cassette is attached and detached.

According to an aspect of the present invention, there is provided a tape printing apparatus, including: a cartridge mounting portion on which a tape cartridge having a core shaft portion disposed on an inner peripheral side of a wound print tape is detachably mounted; an engagement projection portion which protrudes from the cartridge mounting portion and engages with an inner peripheral portion of the core shaft portion of the mounted tape cartridge; and a plurality of spring pieces which are provided in the engagement projection portion, in which the plurality of spring pieces are equally disposed in a peripheral direction in the engagement projection portion, and bias an inner peripheral surface of the engaged core shaft portion toward the outside in a radial direction.

According to this configuration, if the tape cartridge is mounted on the cartridge mounting portion, the inner peripheral portion of the core shaft portion of the tape cartridge engages with the engagement projection portion of the cartridge mounting portion. In this case, since the plurality of spring pieces which bias the inner peripheral surface of the core shaft portion toward the outside in the radial direction are provided in the engagement projection portion, when the tape cartridge is attached and detached, each spring piece guides the tape cartridge while being appropriately bent (deformed elastically). Accordingly, minute positional deviation or minute inclination of the tape cartridge is absorbed, and attachment and detachment of the tape cartridge are smoothly performed. The plurality of spring pieces are equally disposed in the engagement projection portion in the peripheral direction, and bias the inner peripheral surface of the core shaft portion toward the outside in the radial direction. Accordingly, the tape cartridge is positioned at a predetermined position at which the spring forces of the plurality of spring pieces are antagonistic to each other (are cancelled out from each other). Therefore, it is possible to obtain both smoothness of attachment and detachment and appropriate positioning accuracy with respect to the tape cartridge.

In this case, preferably, the tape printing apparatus further includes a spring holder which holds the plurality of spring pieces, the spring holder is disposed inside the engagement projection portion, and the plurality of spring pieces protrude outward from a plurality of openings which are formed in the engagement projection portion.

According to this configuration, it is possible to unitize the plurality of spring pieces via the spring holder, and the plurality of spring pieces can be accurately incorporated into the engagement projection portion. Accordingly, it is possible to set the predetermined position at which the spring forces of the plurality of spring pieces are antagonistic to each other to the center or the like of the engagement projection portion, and it is possible to increase positioning accuracy of the tape cartridge.

In this case, preferably, a mounting base portion configuring the cartridge mounting portion and the engagement projection portion are integrally formed.

According to this configuration, it is possible to simply form the engagement projection portion, and it is possible to simplify the structure around the cartridge mounting portion.

Preferably, the inner peripheral portion of the core shaft portion includes a first recessed portion on the rear side in the engagement direction, and a second recessed portion which is formed to have a larger diameter than that of the first recessed portion and is positioned on the front side in the engagement direction, the engagement projection portion includes a first distal projection portion which engages with the first recessed portion and a second proximal projection portion which engages with the second recessed portion, and the plurality of spring pieces are provided on the second projection portions.

In this case, preferably, a reverse rotation stopping mechanism, which engages with and disengages from a tape core of the print tape and can perform a reverse rotation stop operation and a reverse rotation stop release operation on the tape core, is incorporated into the first recessed portion, and the first projection portion performs the release operation on the reverse rotation stopping mechanism according to the mounting of the tape cartridge.

According to this configuration, the second projection portion of the engagement projection portion can have a function which positions the tape cartridge via the plurality of spring pieces, the first projection portion can have a function which releases the reverse rotation stopping mechanism of the tape core, and the functions can be collectively disposed.

Preferably, each spring piece is formed by bending a wire having spring properties.

According to this configuration, it is possible to simply form a plurality of spring pieces having the same shape. The spring pieces can come into contact with the inner peripheral surface of the core shaft portion in a point shape or a linear shape, and can bias the core shaft portion by stable spring forces. Accordingly, it is possible to appropriately position the tape cartridge.

In this case, preferably, each spring piece includes a held spring portion which is held by the spring holder, and a bent spring portion which extends from the held spring portion and includes an apex portion coming into contact with the inner peripheral surface of the core shaft portion.

According to this configuration, it is possible to increase a spring stroke, and it is possible to stably bias the inner peripheral surface of the core shaft portion. Accordingly, it is possible to appropriately position the tape cartridge.

In this case, preferably, a plurality of through holes with which the bent spring portions of the spring pieces engage are provided on the inner peripheral surface of the core shaft portion, each of the bent spring portions is formed to be bent in an elbow shape, and the bent spring portion engages with the through hole while being elastically deformed according to the engagement of the core shaft portion with respect to the engagement projection portion, and comes into contact with a base end of the through hole in a state where the bent spring portion engages with the through hole.

According to this configuration, if the inner peripheral portion of the core shaft portion engages with the engagement projection portion, the bent spring portion engages with the through hole while being elastically deformed. That is, it is possible to allow the engagement projection portion and the core shaft portion to engage with each other in a click manner by the plurality of spring pieces, and it is possible to decrease the mounting failure of the tape cartridge. Since the bent spring portion comes into contact with the base end of the through hole in the state where the bent spring portion engages with the through hole, it is possible to press the tape cartridge via the base end of the through hole by the plurality of spring pieces. Accordingly, it is possible to prevent floating of the tape cartridge.

Preferably, the plurality of spring pieces are integrally formed with the engagement projection portion.

According to this configuration, it is possible to allow the engagement projection portion and the plurality of spring pieces to be simple structures, and to simply form the engagement projection portion and the plurality of spring pieces.

Meanwhile, preferably, the tape printing apparatus includes a detection portion which comes into electric contact with a detection object which is provided on the inner peripheral portion of the core shaft portion of the mounted tape cartridge so as to be conductive with the detection object, and detects attribution information of the tape cartridge, the detection portion includes the plurality of spring pieces which are configured of conductive metal wires having spring properties, and the plurality of spring pieces are connected to a detection circuit which detects binarized attribution information.

According to this configuration, it is possible to increase the size of the detection portion with respect to the detection object which is provided on the core shaft having a relatively large size. Accordingly, it is possible to dispose the plurality of spring pieces at appropriate intervals in the peripheral direction, and it is possible to increase the number of the spring pieces. Therefore, it is possible to improve stability of detection, and it is possible to increase an amount of the attribute information of the tape cartridge.

In this case, preferably, the detection object further includes: a wiring pattern substrate in which a plurality of contact terminals including contact portions with which the plurality of spring pieces come into contact, and a conduction/non-conduction wiring portion which is connected to the plurality of contact terminals are provided; and a cylindrical substrate cover which covers the wiring pattern substrate, in which the plurality of spring pieces come into contact with the contact terminals via a plurality of through holes which are formed on the substrate cover.

According to this configuration, it is possible to stably provide the detection object, and it is possible to reliably detect the attribute information of the tape cartridge.

According to another aspect of the present invention, there is provided a tape printing system, including: the above-described tape printing apparatus; and a tape cartridge which is detachably mounted on the cartridge mounting portion.

According to this configuration, it is possible to smoothly perform attachment and detachment of the tape cartridge, and it is possible to mount the tape cartridge with improved positioning accuracy. Accordingly, it is possible to improve handleability and print quality.

BRIEF DESCRIPTION OF THE DRAWINGS

FIGS. 14A and 14B show a second embodiment, of which, FIG. 14A is an enlarged sectional view around a positioning protrusion portion in which conductive contactors of the first embodiment function as simple spring pieces, and FIG. 14B is an enlarged sectional view of a modification example thereof.

DESCRIPTION OF EXEMPLARY EMBODIMENTS

Hereinafter, a tape printing apparatus and a tape printing system according to an embodiment of the present invention are described with reference to accompanying drawings. The tape printing apparatus performs printing while continuously feeds a print tape and an ink ribbon from a mounted tape cartridge, and cuts a printed portion of the print tape to prepare a label (tape piece). The tape printing system is configured of the tape printing apparatus and a tape cartridge which is mounted on the tape printing apparatus so as to be used.

Outline of Tape Printing Apparatus

Figure 1:
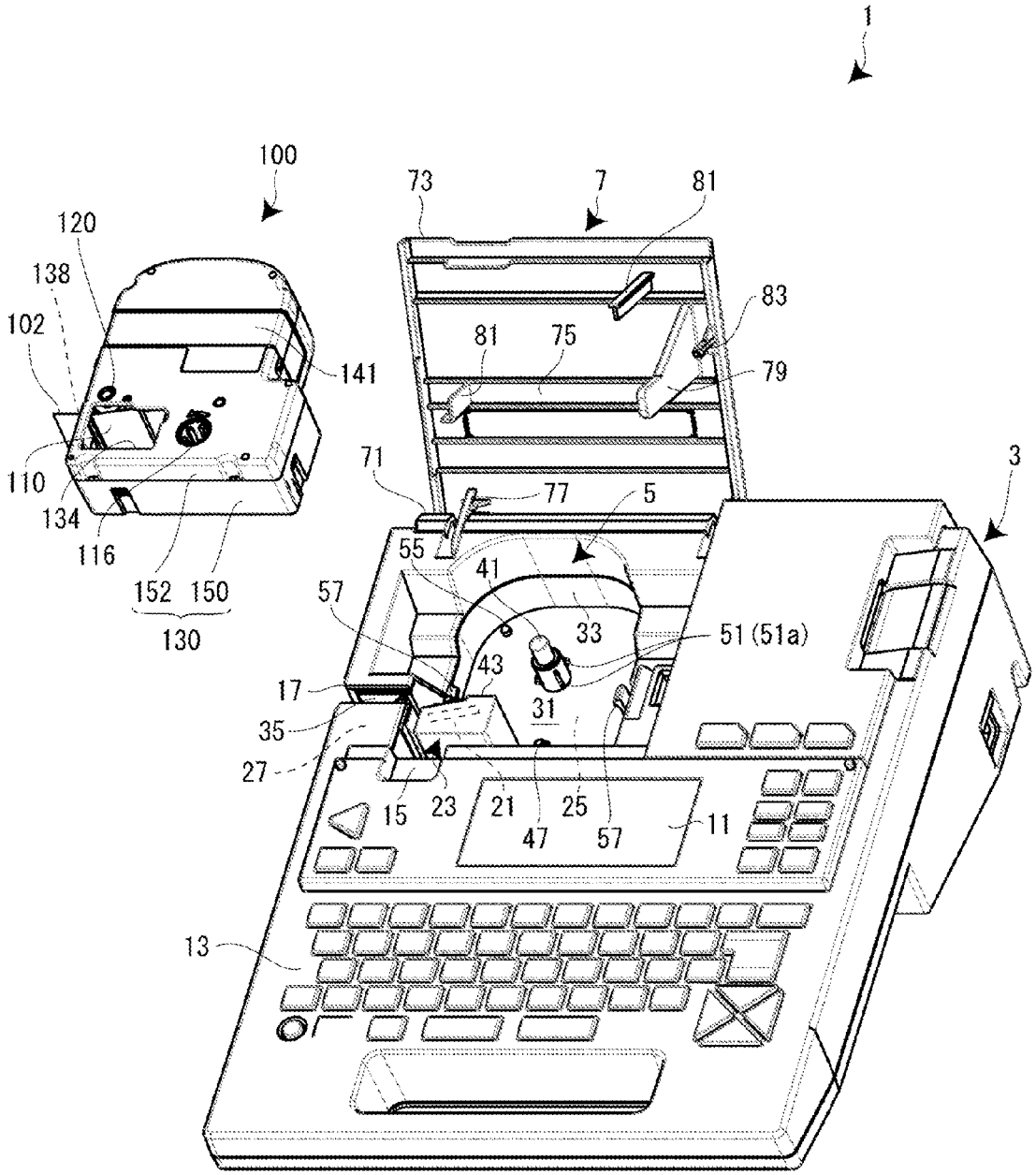
FIG. 1 is an external perspective view showing a state where a cover is open in a tape printing apparatus according to an embodiment.

FIG. 1 is an external perspective view of the tape printing apparatus and the tape cartridge mounted on the tape printing apparatus, in which the tape printing apparatus and the tape cartridge configure the tape printing system. As shown in FIG. 1, a tape printing apparatus 1 includes an apparatus case 3 which configures an outer shell, a cartridge mounting portion 5 on which a tape cartridge 100 is detachably mounted, and an opening/closing cover 7 which opens and close the cartridge mounting portion 5. On the upper surface of the apparatus case 3, the cartridge mounting portion 5 is provided on the rear side of the upper surface, a display 11 is provided on the center thereof, and a key board 13 is provided on the front side thereof. A finger hooking depression portion 15 is provided in the vicinity of the opening/closing cover 7, and the opening/closing cover 7 is opened by hooking fingers to the depression portion 15 and lifting the depression portion 15. A vertically long tape discharge port 17 through which a print tape 102 is discharged is provided on a side surface (left surface) of the apparatus case 3.

The tape printing apparatus 1 includes a printing mechanism portion 23 having a print head 21 which uprightly stands on the cartridge mounting portion 5, a tape feeding mechanism portion 25 which is built in the rear space of the cartridge mounting portion 5, and a tape cutting mechanism portion 27 which is built in the vicinity of the tape discharge port 17. After a user inputs print information to the keyboard 13 and confirms the print information by the display 11, the user performs printing by operating keys. If printing command is performed, the tape feeding mechanism portion 25 is driven, the print tape 102 and an ink ribbon 110 travel in parallel, and thus, the printing is performed by heat transfer using the printing mechanism portion 23. According to the print feeding, if the print tape 102 is discharged from the tape discharge port 17 and the printing is completed, the tape cutting mechanism portion 27 is driven, and the printed portion of the print tape 102 is separated from the print tape 102.

Outline of Tape Cartridge

Figure 2A:
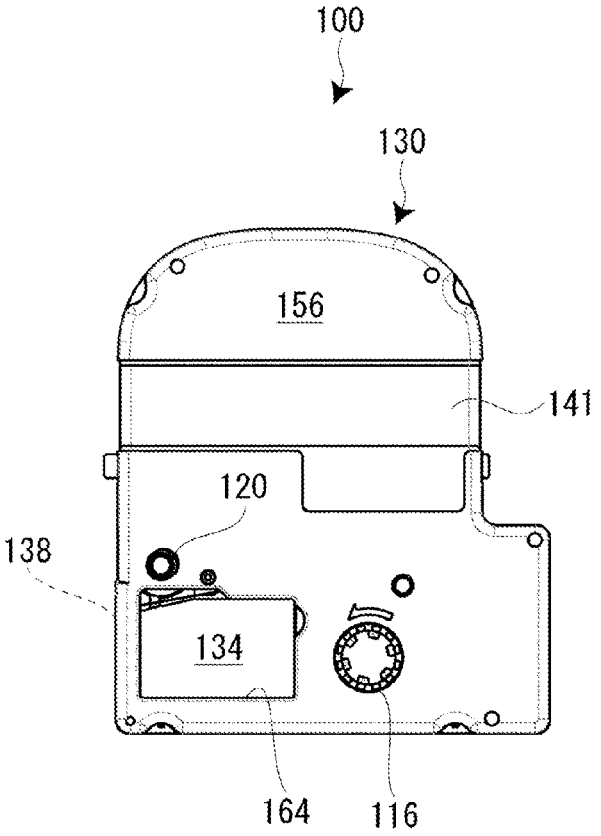
FIG. 2A is a plan view of a tape cartridge according to an embodiment and FIG. 2B is a side view thereof.
Figure 2B:
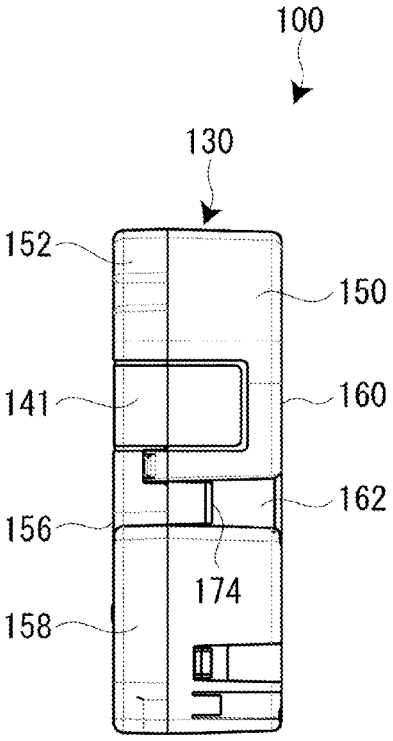

As shown in FIGS. 2 and 5, the tape cartridge 100 includes a tape roll 106 in which the print tape 102 is wound around a tape core 104, and a ribbon roll 114 in which the ink ribbon 110 is wound around a delivery core 112. The tape cartridge 100 includes a winding core 116 which winds the used ink ribbon 110, and a platen roller 120 (platen) with which the print head 21 comes into contact via the ink ribbon 110 and the print tape 102 and which feeds the print tape 102 and the ink ribbon 110. The tape cartridge 100 further includes a cartridge case 130 in which the tape roll 106, the ribbon roll 114, the winding core 116, and the platen roller 120 are accommodated. In this way, the tape cartridge 100 of the present embodiment has a so-called shell structure in which the outer shell thereof is covered by the cartridge case 130.

In the tape cartridge 100, an insertion opening 134, into which the print head 21 is inserted when the tape cartridge 100 is mounted on the tape printing apparatus 1, is formed in the cartridge case 130. The tape cartridge 100 includes a tape feed-out port 138 which is formed in the cartridge case 130 and through which the print tape 102 is fed out. Although the details will be described below, the tape roll 106 is rotatably supported by a cylindrical core shaft portion 192 protruding toward the inside of the cartridge case 130 (refer to FIG. 5A).

If the platen roller 120 and the winding core 116 are driven by the tape feeding mechanism portion 25, the print tape 102 is continuously fed from the tape core 104, and the ink ribbon 110 is continuously fed from the delivery core 112. The continuously fed print tape 102 and the ink ribbon 110 travel in parallel in the portion of the platen roller 120, and are supplied for the printing by the print head 21. The delivered end portion (printed portion) of the print tape 102 subjected to the printing is fed from the tape feed-out port 138 toward the tape discharge port 17. Meanwhile, the ink ribbon 110 rotates around the peripheral wall portion of the insertion opening 134 and is wound around the winding core 116. A plurality of kinds of tape cartridges 100 are prepared, in which thicknesses thereof are different from each other according to the tape widths of the print tapes 102.

Detail of Tape Printing Apparatus

Figure 3:
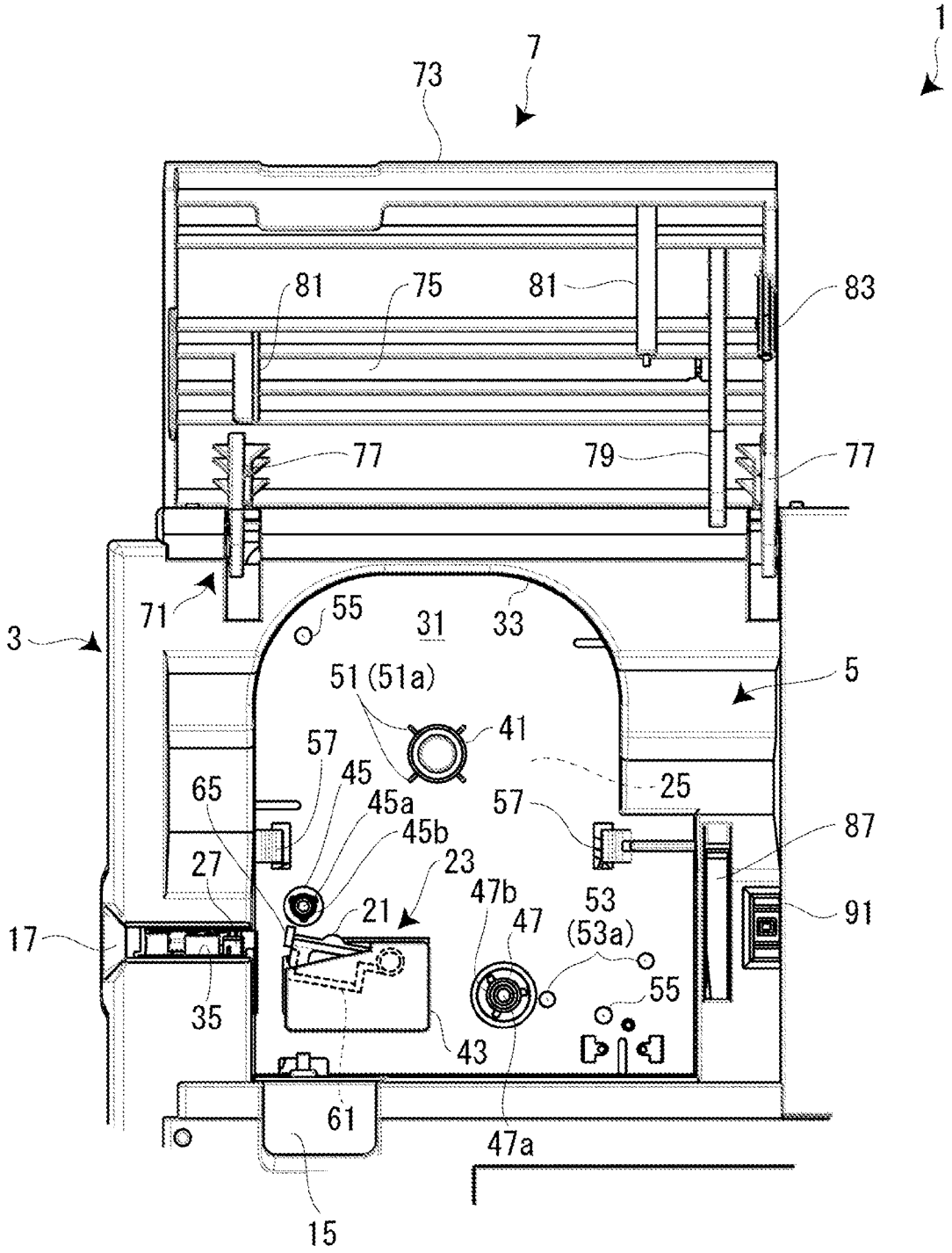
FIG. 3 is a plan view of a cartridge mounting portion.

As shown in FIGS. 1 and 3, the cartridge mounting portion 5 is formed in a plane shape complementary to the plane shape of the tape cartridge 100, and is formed to be recessed so as to have the depth corresponding to the tape cartridge 100 having the maximum thickness among the plurality of kinds of mountable tape cartridges 100. In this case, a mounting base 31 and a side plate portion 33 configuring the bottom plate portion of the cartridge mounting portion 5 are integrally formed (molded) of a resin or the like. A slit-shaped tape discharge path 35 is formed between the cartridge mounting portion 5 and the tape discharge port 17, and the tape cutting mechanism portion 27 is built in the portion of the tape discharge path 35.

In the mounting base 31 of the cartridge mounting portion 5, a positioning protrusion portion 41 (engagement projection portion) which is positioned so as to be fitted to the inner peripheral portion (recessed portion) of the core shaft portion 192 (refer to FIGS. 5A and 5B) of the tape cartridge 100 when the tape cartridge 100 is mounted, the print head 21 which is covered by a head cover 43, a platen drive shaft 45 which rotationally drives the platen roller 120, and a winding drive shaft 47 which rotationally drives the winding core 116 uprightly stand. A detection portion 51 which detects a kind (attribute information) of the tape cartridge 100 is incorporated into the positioning protrusion portion 41 (the details will be described below).

Meanwhile, a core release portion 53 which releases rotation stopping of the delivery core 112 and the winding core 116 is provided in the vicinity of the winding drive shaft 47 in the mounting base 31. In the mounting base 31, a pair of small protrusions 55 are provided at diagonal positions, and a pair of hooking pieces 57 which hook the intermediate portions of the mounted tape cartridge 100 are provided.

The tape feeding mechanism portion 25 is built in the rear space of the mounting base 31, and the tape feeding mechanism portion 25 includes a motor and a gear train (not shown) which rotate the platen drive shaft 45 and the winding drive shaft 47. The tape feeding mechanism portion 25 divides power by the gear train, and synchronously rotates the platen drive shaft 45 and the winding drive shaft 47. Although it is not shown in FIGS. 1 and 3, a control substrate is built in the rear space of the key board 13, and a detection circuit 52 (refer to FIG. 9) connected to the detection portion 51, or a control circuit controlling the printing mechanism portion 23, the tape feeding mechanism portion 25, or the like is mounted on the control substrate.

The printing mechanism portion 23 includes the print head 21 which is configured of a thermal head, a head support frame 61 which supports and rotates the print head 21, a head release mechanism (not shown) which rotates the print head 21 via the head support frame 61 between a print position and a retreat position, and the head cover 43 which covers the print head 21 (and the head support frame 61).

The head release mechanism is operated in interlock with opening and closing of the opening/closing cover 7, moves (rotates) the print head 21 to the print position in interlock with the closing operation of the opening/closing cover 7, and moves (rotates) the print head 21 to the retreat position in interlock with the opening operation thereof. The print head 21 which has moved to the print position comes into contact with the platen roller 120 of the tape cartridge 100 via the ink ribbon 110 and the print tape 102, and the print head 21 which has moved to the retreat position is separated from the platen roller 120. Accordingly, interference between the print tape 102 or the ink ribbon 110 and the print head 21 is prevented when the tape cartridge 100 is attached and detached.

A plurality of heater elements are provided in the print head 21, and the plurality of heater elements are arranged in the same direction as the axial direction of the platen roller 120. The printing is performed by feeding of the print tape 102 and the ink ribbon 110 and selective driving of the plurality of heater elements. The head cover 43 is formed in an approximately rectangular shape in a plan view, and is integrally formed (molded) with the mounting base 31 (the cartridge mounting portion 5). The head cover 43 largely protrudes vertically from the mounting base 31, allows the print head 21 to rotate inside the head cover 43, and functions as a mounting guide of the tape cartridge 100 outside the head cover 43.

Although the details will be described below, the detection portion 51 includes a plurality of conductive contactors 51*a*. The detection portion 51 is selectively conductive with a detection object 180 of the tape cartridge 100, and mainly detects a kind (attribute information) of the tape cartridge 100 such as a tape width, tape color, or a material of the print tape 102. The driving of the print head 21 or the tape feeding mechanism portion 25 is controlled on the basis of the detection result. The plurality of conductive contactors 51*a* have spring properties, and bias the inner peripheral surface of the core shaft portion 192 in the detection object 180 toward the outside in the radial direction. That is, each of the conductive contactors 51*a* function as a "spring piece" described in claims.

The core release portion 53 is configured of two release pins 53*a* for the delivery core 112 and the winding core 116. Although the details will be described below, a rotation stopping hook 206 (refer to FIG. 6) which is locked to each of the delivery core 112 and the winding core 116 is provided in the cartridge case 130. If the tape cartridge 100 is mounted, the release pins 53*a* engage with the rotation stopping hooks 206, and the rotation stopping of the delivery core 112 and the winding core 116 are released.

The platen drive shaft 45 includes a fixed shaft 45*a* which is provided to be inserted into the platen roller 120, and a movable splined shaft 45*b* which is pivotally supported by the base portion of the fixed shaft 45*a*. Rotational power of the tape feeding mechanism portion 25 is transmitted to the movable shaft 45*b*, and is transmitted from the movable shaft 45*b* to the platen roller 120. Similarly, the winding drive shaft 47 includes a fixed shaft 47*a* and a movable splined shaft 47*b* which is pivotally supported by the fixed shaft 47*a*. In this case, the rotational power of the tape feeding mechanism portion 25 is transmitted to the movable shaft 47*b*, and is transmitted from the movable shaft 47*b* to the winding core 116.

If the tape cartridge 100 is mounted on the cartridge mounting portion 5, the core shaft portion 192 (tape core 104) engages with the positioning protrusion portion 41 (refer to FIG. 9), the platen roller 120 engages with the platen drive shaft 45, and the winding core 116 engages with the winding drive shaft 47. If the opening/closing cover 7 is closed, the print head 21 rotates and comes into contact with the platen roller 120 in a state where the print tape 102 and the ink ribbon 110 are interposed between the print head 21 and the platen roller 120, and the tape printing apparatus 1 is brought into a printing standby state.

Figure 4:
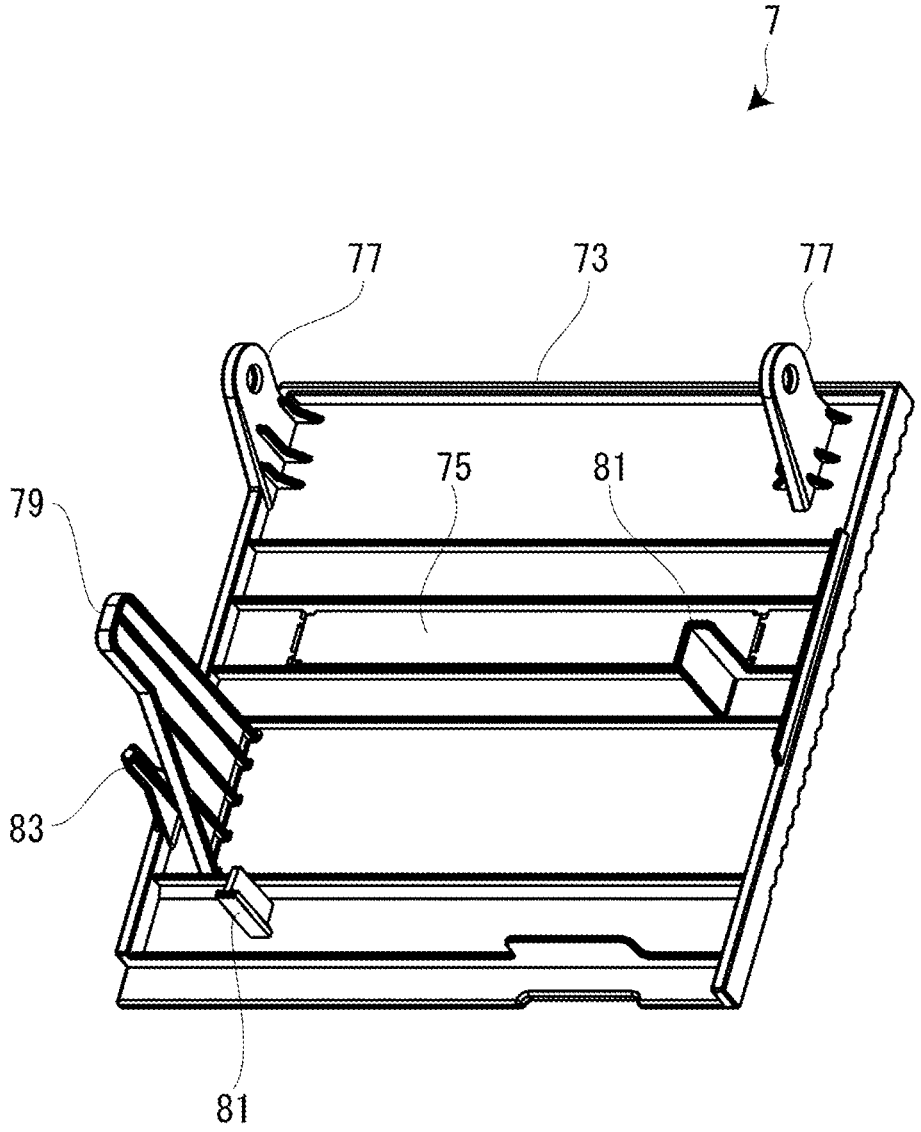
FIG. 4 is a perspective view when an opening/closing cover is viewed from the rear surface side thereof.

As shown in FIGS. 1 and 4, the opening/closing cover 7 is attached to the apparatus case 3 so as to be rotatable, that is, to be openable and closable, via a hinge portion 71 which is provided on the rear side of the opening/closing cover 7.

The opening/closing cover 7 includes an opening/closing cover body 73, and an observation window 75 which is provided on the center of the opening/closing cover body 73. The opening/closing cover 7 includes a pair of pivotally supporting pieces 77 which protrude from the rear surface of the opening/closing cover body 73 and is rotatably pivoted by the hinge portion 71, and an operation lever 79 which protrudes from the rear surface of the opening/closing cover body 73 and rotates the print head 21. The opening/closing cover 7 includes two pushing protrusions 81 which protrude from the rear surface of the opening/closing cover body 73 and push the tape cartridge 100 into the inside thereof, and a pressing protrusion 83 which protrudes from the rear surface of the opening/closing cover body 73 and operates (turns on) a built-in cover closing detection switch (not shown).

The observation window 75 is formed longitudinally, and is configured of a transparent (transparent with respect to visible light) resin which is separated from the opening/closing cover body 73. The tape cartridge 100 mounted on the cartridge mounting portion 5 (a kind of the print tape 102 and a remaining amount of the tape) can be viewed through the observation window 75. The pair of pivotally supporting pieces 77, the operation lever 79, the two pushing protrusions 81, the pressing protrusion 83, and the opening/closing cover body 73 are integrally formed (molded) of a resin.

The operation lever 79 largely protrudes from the rear surface of the opening/closing cover body 73, and is inserted into a slit opening 87 which is provided on the side of the cartridge mounting portion 5 according to closing of the opening/closing cover 7. The operation lever 79 which is inserted into the slit opening 87 operates the head release mechanism, and rotates the print head 21 toward the platen roller 120. Similarly, the pressing protrusion 83 is inserted into a rectangular opening 91 adjacent to the slit opening 87 according to closing of the opening/closing cover 7, and turns on the cover closing detection switch.

One pushing protrusion 81 corresponds to the position around the platen roller 120 of the tape cartridge 100, and the other pushing protrusion 81 is disposed so as to be separated from this position. If the opening/closing cover 7 is closed, the two pushing protrusions 81 push the tape cartridge 100 into the cartridge mounting portion 5 such that the tape cartridge 100 seats on the mounting base 31 of the cartridge mounting portion 5, and prevents floating of the tape cartridge 100.

Details of Tape Cartridge

Next, the tape cartridge 100 is described in detail with reference to FIGS. 2A, 2B, 5A, 5B, and 6. In descriptions of the tape cartridge 100, for example, in FIGS. 2A and 2B, the front surface in the mounting direction which is the front surface of the tape cartridge 100 is referred to as a "front surface", the rear surface in the mounting direction which is opposite to the front surface is referred to as a "rear surface", the side surface of the left side is referred to as a "left surface", the side surface of the right side is referred to as a "right surface", an arc surface of the upper side is referred to as a "tip surface", and the surface of the lower side is referred to as a "base end surface".

As described above, the tape cartridge 100 includes the cartridge case 130, and the tape roll 106, the ribbon roll 114, the winding core 116, and the platen roller 120 which are accommodated in the cartridge case 130. The tape cartridge 100 includes the insertion opening 134 which is formed in the cartridge case 130, the tape feed-out port 138 which is formed on the left surface in the vicinity of the platen roller 120, and an identification seal 141 (refer to FIG. 1) which is bonded to the front surface, the left surface, and the right surface of the portion in which the tape roll 106 is accommodated. In the identification seal 141, the tape width, the tape color, the material (a portion of attribute information), or the like of the accommodated print tape 102 is indicated at two locations of the front surface and the left surface.

The cartridge case 130 configures the outline of the tape cartridge 100 (shell structure), and has an L-shaped appearance in a plan view in which the proximal side of the right surface slightly protrudes. The cartridge case 130 in forward and rearward directions includes a lower case 150 which becomes the rear side when the cartridge is mounted on the cartridge mounting portion 5, and an upper case 152 which becomes the front side. In the cartridge case 130 of the embodiment, the upper case 152 is configured of a molded article formed of a transparent resin, and the lower case 150 is configured of a molded article formed of an opaque resin.

The upper case 152 is integrally formed (molded) of a top wall portion 156 configuring the front surface of the cartridge case 130, and an upper peripheral wall portion 158 which is vertically provided on the peripheral edge portion of the top wall portion 156. The lower case 150 is integrally formed (molded) of a bottom wall portion 160 configuring the rear surface of the cartridge case 130, a lower peripheral wall 162 which uprightly stands on the peripheral edge portion of the bottom wall portion 160, and an opening peripheral wall portion 164 which uprightly stands on the bottom wall portion 160 in order to define the insertion opening 134.

Figures 5A, 5B:
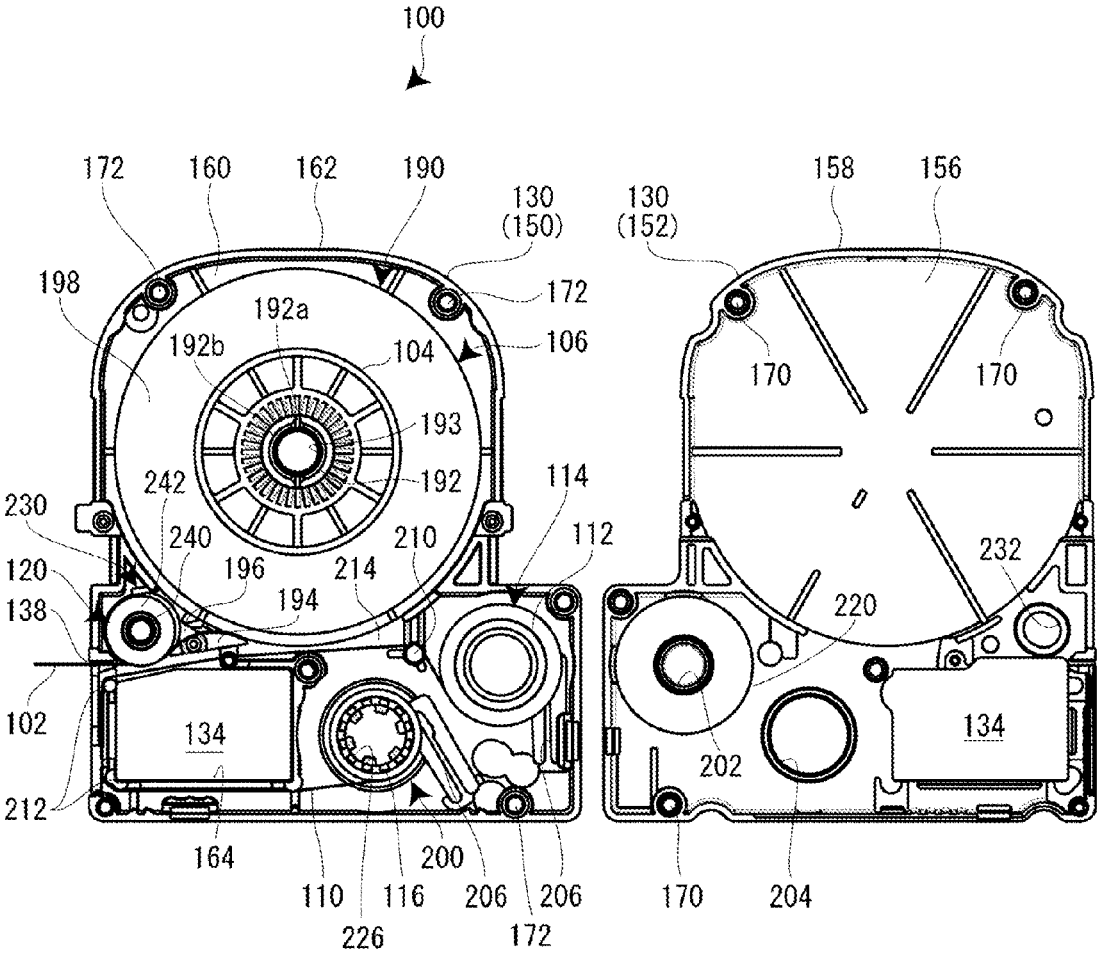
FIG. 5A is a plan view of an upper case and the tape cartridge in a state where the upper case is removed.
FIG. 5B is rear view of the upper case.

While a plurality of joining pins 170 are provided at appropriate intervals on the lower end surface of the upper peripheral wall portion 158 in the upper case 152, a plurality of joining holes 172 corresponding to the plurality of joining pins 170 are provided on the lower peripheral wall 162 of the lower case 150 (refer to FIGS. 5A and 5B). After components such as the tape roll 106 or the ribbon roll 114 are set to the lower case 150, the upper case 152 is joined to the lower case 150 such that the plurality of joining pins 170 are pressed into the plurality of joining holes 172, and thus, the tape cartridge 100 is assembled. Each joining hole 172 is a through hole in consideration of easiness of the molding.

Figure 6:
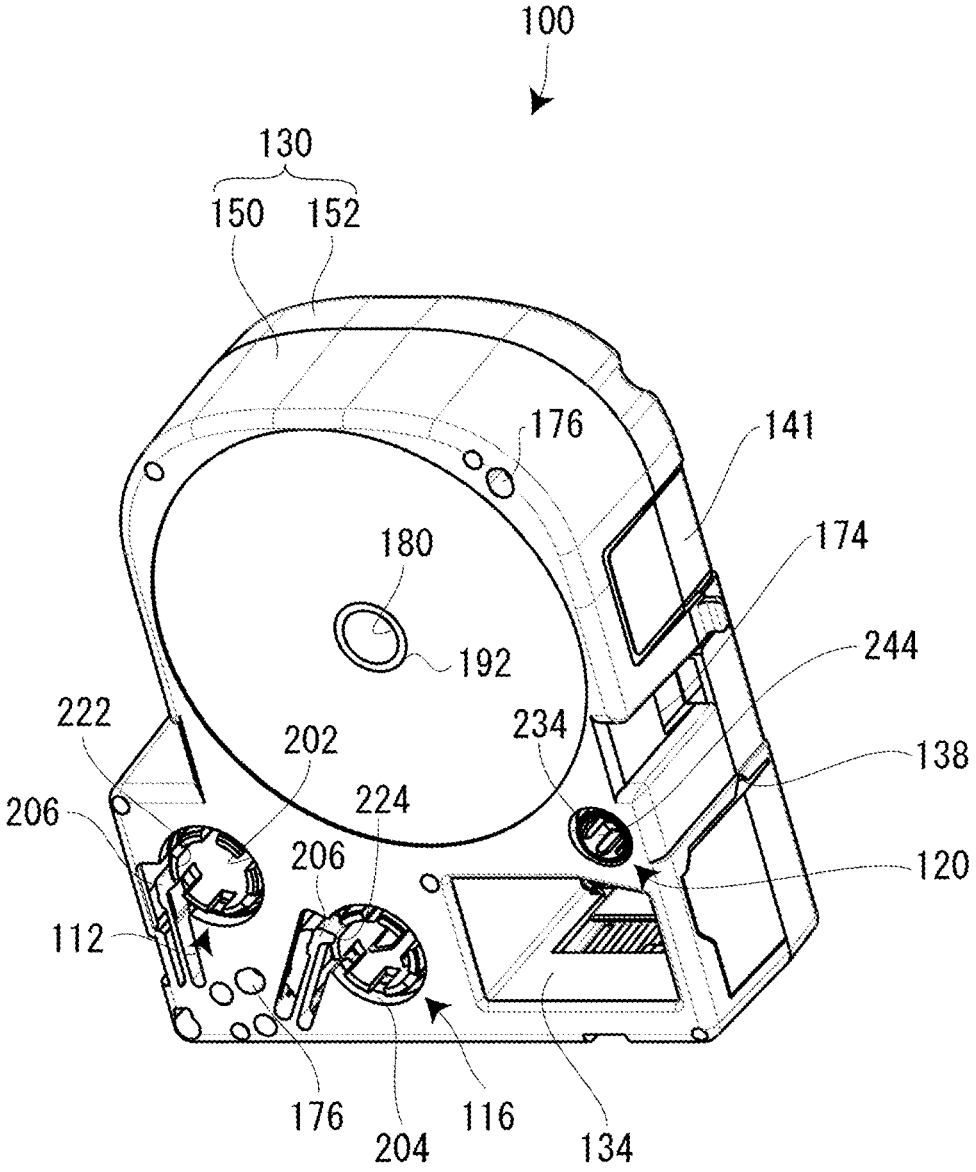
FIG. 6 is a perspective view when the tape cartridge is viewed from the rear surface side thereof.

Meanwhile, a pair of lock-receiver portions 174 which are hooked to the pair of hooking pieces 57 are provided on the left surface and the right surface of the lower case 150 (refer to FIGS. 2 and 6). The pair of hooking pieces 57 on the cartridge mounting portion 5 side are hooked to the pair of lock-receiver portions 174 of the mounted tape cartridge 100, and thus, floating of the tape cartridge 100 is prevented. Fitting small holes 176, to which the pair of small protrusions 55 are fitted with a slight allowance, are provided on the rear surface of the lower case 150 (refer to FIG. 6). The pair of small protrusions 55 on the cartridge mounting portion 5 side are fitted to the pair of fitting small holes 176 of the mounted tape cartridge 100, and thus, simple positioning of the tape cartridge 100 on the mounting base 31 is performed.

As shown in FIGS. 5A and 5B, a tape accommodation area 190 in which the tape roll 106 is accommodated widely is configured on the upper space (tip surface side) inside the cartridge case 130. The core shaft portion 192, which is integrally formed (molded) with the lower case 150, uprightly stands on the center of the tape accommodation area 190. The core shaft portion 192 is cylindrically formed, and the tape roll 106 (tape core 104) is pivotally supported by an outer peripheral surface 192*b* of the core shaft portion 192. That is, the core shaft portion 192 is positioned on the inner peripheral side of the tape roll 106 when viewed in a core axial direction. Although the details will be described below, a reverse rotation stopping spring 193 (reverse rotation stopping mechanism) of the tape roll 106 configured of a coil spring is incorporated into the core shaft portion 192.

The detection object 180 corresponding to the detection portion 51 is provided on the inner peripheral portion of the core shaft portion 192 (refer to FIG. 6). Although the details will be described below, the detection object 180 includes a wiring pattern substrate 324 corresponding to the plurality of conductive contactors 51*a* of the detection portion 51, and by selective conduction of the plurality of conductive contactors 51*a* with respect to the wiring pattern substrate 324, a plurality of bit patterns are obtained. That is, the bit pattern corresponds to the above-described attribute information of the tape cartridge 100.

A tape guide 194, through which the continuously fed print tape 102 is introduced to the platen roller 120, uprightly stands integrally with the lower case 150 in the vicinity of the platen roller 120 in the tape accommodation area 190. That is, a tape feeding path 196 is configured inside the cartridge case 130, and the tape feeding path reaches the tape feed-out port 138 via the tape guide 194 and the platen roller 120 from the tape roll 106 which is a starting point. The print tape 102 continuously fed from the tape roll 106 is introduced to the platen roller 120 via the tape guide 194, and here, the print tape 102 is supplied for printing, and is introduced from the platen roller 120 to the tape feed-out port 138.

The tape roll 106 includes the print tape 102 and the tape core 104, and includes two circular films 198 which are bonded to both end surfaces of the wound print tape 102. The two circular films 198 prevent loosening of the print tape 102 which is wound around the tape core 104.

The tape core 104 includes a reel portion 104*a* around which the print tape 102 is wound, and a roll-contact portion 104*c* which is provided inside the reel portion 104*a* via a plurality of inward ribs 104*b*, and the tape core 104 is pivotally supported to the core shaft portion 192 by the roll-contact portion 104*c*. A plurality of radial end surface grooves 104*d* are formed on the end surface of the roll-contact portion 104*c*, and the reverse rotation stopping spring 193 engages with and disengage from the end surface grooves 104*d*. That is, a vertical slit 192*a* extending in the axial direction is formed on the upper portion of the core shaft portion 192, and the wire end portion of the reverse rotation stopping spring 193 protrudes from the vertical slit 192*a* and engages with the end surface groove 104*d* of the roll-contact portion 104*c*.

When the tape cartridge 100 is carried, the reverse rotation of the tape roll 106 (print tape 102) is prevented by the reverse rotation stopping spring 193. Meanwhile, if the tape cartridge 100 is mounted on the cartridge mounting portion 5, the reverse rotation stopping spring 193 (refer to FIG. 9) is compressed by the positioning protrusion portion 41, the wire end of the reverse rotation stopping spring 193 is separated from the end surface groove 104*d* of the roll-contact portion 104*c*, and the reverse rotation stopping is released. Accordingly, feeding of the print tape 102 can be performed.

A ribbon accommodation area 200 adjacent to the insertion opening 134 is configured on the right side of the base portion inside the cartridge case 130. A delivery side bearing portion 202 which is positioned to be closer to the right side of the ribbon accommodation area 200 and rotatably supports the ribbon roll 114 (delivery core 112), and a winding side bearing portion 204 which is positioned to be closer to the left side thereof and rotatably supports the winding core 116 are integrally formed with the cartridge case 130. That is, the delivery side bearing portion 202 and the winding side bearing portion 204 are respectively formed on the upper case 152 and the lower case 150.

The rotation stopping hooks 206 having distal portions facing the delivery side bearing portion 202 and the winding side bearing portion 204 are respectively formed integrally with the notched portions of the delivery side bearing portion 202 and the winding side bearing portion 204 formed on the lower case 150. One rotation stopping hook 206 engages with the delivery core 112 in a state where the rotation thereof stops, and the other rotation stopping hook 206 engages with the winding core 116 in a state where the rotation thereof stops.

A first ribbon guide 210, through which the continuously fed ink ribbon 110 is introduced to the platen roller 120, uprightly stands integrally with the lower case 150 in the vicinity of the delivery side bearing portion 202 in the ribbon accommodation area 200. A plurality of second ribbon guides 212 which guide the rotation of the ink ribbon 110 are integrally formed with the outer peripheral side of the opening peripheral wall portion 164.

That is, a ribbon feeding path 214 is configured inside the cartridge case 130, and the tape feeding path reaches the winding core 116 via the first ribbon guide 210, the platen roller 120, and the plurality of second ribbon guides 212 from the ribbon roll 114 which is a starting point. The ink ribbon 110 continuously fed from the ribbon roll 114 is introduced to the platen roller 120 via the first ribbon guide 210, and here, the ink ribbon 110 is supplied for printing, and rotates around the opening peripheral wall portion 164 (plurality of second ribbon guides 212) from the platen roller 120 so as to be wound around the winding core 116.

The ribbon roll 114 includes the ink ribbon 110 and the delivery core 112, and includes an annular plate spring 220 which applies a braking load to the delivery core 112 (refer to FIG. 5B). The plate spring 220 is formed in a wave shape in the peripheral direction, and is interposed between the top wall portion 156 and the delivery core 112 of the upper case 152 in the axial direction. That is, a rotation braking load is applied to the delivery core 112 by a resilient force of the plate spring 220. Accordingly, back tension is applied to the ink ribbon 110 continuously fed by the winding core 116, and loosening of the ink ribbon is prevented.

The delivery core 112 is cylindrically formed, and a plurality of notches 222 are formed on the end portion on the lower case 150 side of the delivery core 112 in the peripheral direction (refer to FIG. 6). The rotation stopping hook 206 engages with and disengages from the plurality of notches 222. The delivery side bearing portion 202 of the lower case 150 side which supports the delivery core 112 is configured of a circular opening, and the delivery side bearing portion 202 of the upper case 152 side is configured of a cylindrical protrusion portion. The plate spring 220 is mounted on the protrusion portion (refer to FIG. 5B).

Similarly, the winding core 116 is cylindrically formed, and a plurality of notches 224 are formed on the end portion on the lower case 150 side of the winding core 116 in the peripheral direction. The rotation stopping hook 206 engages with and disengages from the plurality of notches 224. Spline grooves 226 are formed on the inner peripheral surface of the winding core 116, and spline-engages with the winding drive shaft 47. Accordingly, the rotating force of the winding drive shaft 47 is transmitted to the winding core 116, and the ink ribbon 110 is wound.

A platen accommodation area 230 adjacent to the insertion opening 134 is formed on the left side of the base portion inside the cartridge case 130. A lower bearing portion 234 (refer to FIG. 6) which is an elliptical opening formed on the lower case 150, and an upper bearing portion 232 (refer to FIG. 5B) which is an elliptical opening formed on the upper case 152 are provided at the center of the platen accommodation area 230. The platen roller 120 is supported by the upper bearing portion 232 and the lower bearing portion 234 such that the platen roller 120 is rotatable and is slightly movable laterally. That is, the platen roller 120, which is supported by the elliptical upper bearing portion 232 and lower bearing portion 234, is configured such that the platen roller 120 is movable laterally (movable slightly) between a home position at which the platen roller engages with the platen drive shaft 45 and a holding position at which the platen roller comes into contact with the tape guide 194 in a state where the print tape 102 is interposed therebetween.

The tape cartridge 100 is carried in a state where the delivered end portion of the print tape 102 slightly protrudes from the tape feed-out port 138 to the outside (refer to FIG. 1). At this time, if a pushing-in force or a pulling-in force is falsely applied to the delivered end portion of the print tape 102, the platen roller 120 dragged by the delivered end portion moves to the holding position. Accordingly, the delivered end portion of the print tape 102 is prevented from being drawn into the cartridge case 130 from the tape feed-out port 138.

The platen roller 120 includes a cylindrical roller base body 240, and a rubber roller 242 which is mounted on the outer peripheral surface of the roller base body 240. The rubber roller 242 has a length corresponding to that of the print head 21 in the axial direction, and the print head 21 which has moved to the print position comes into contact with the rubber roller 242 in a state where the print tape 102 and the ink ribbon 110 are interposed therebetween. Spline grooves 244 are formed on the inner peripheral surface of the roller base body 240, and spline-engage with the platen drive shaft 45. Accordingly, the rotating force of the platen drive shaft 45 is transmitted to the platen roller 120, and the print tape 102 (and the ink ribbon 110) is fed for printing.

Details of Detection Portion and Detection Object (First Embodiment)

Figure 7:
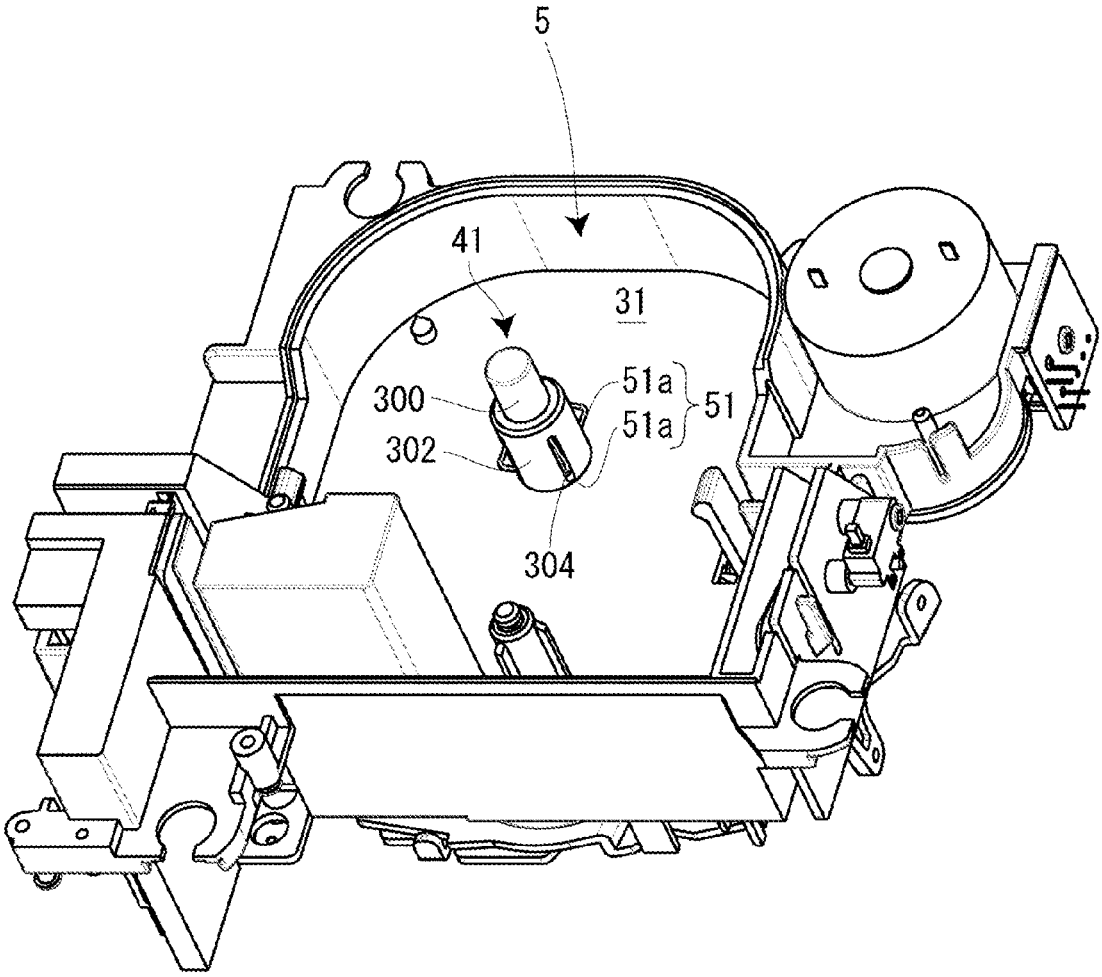
FIG. 7 is a perspective view of the cartridge mounting portion.
Figure 8:
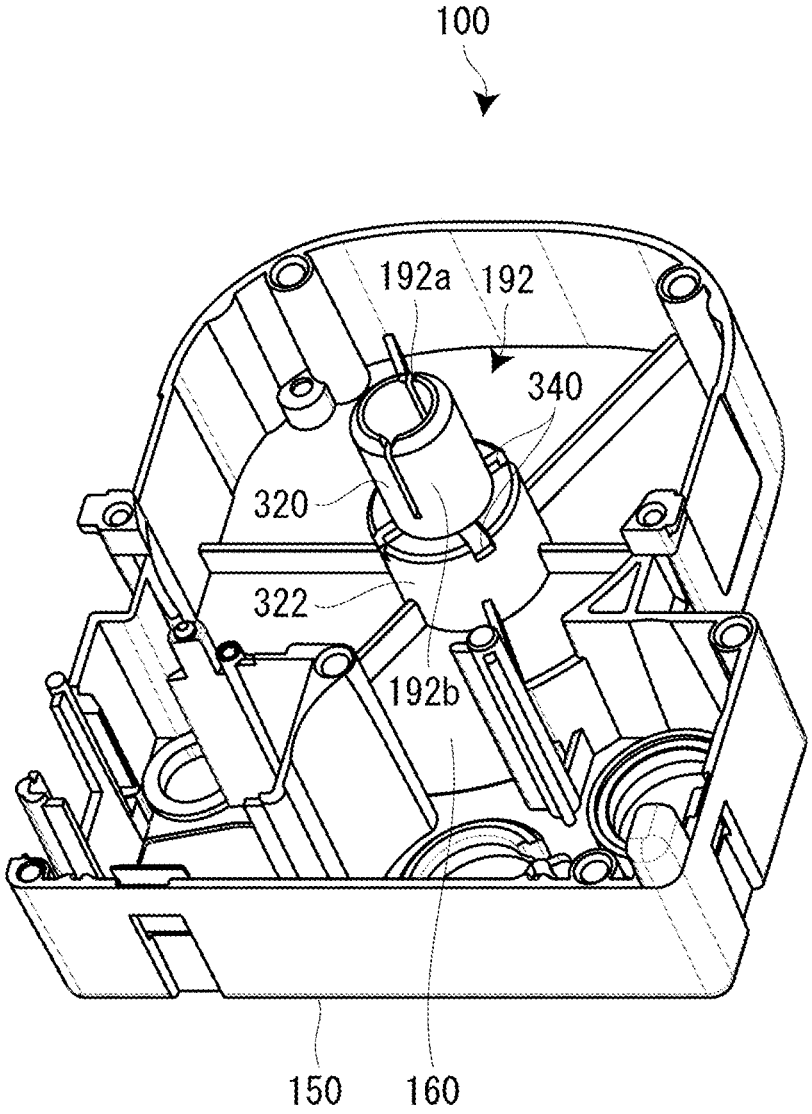
FIG. 8 is a perspective view of a lower case of the tape cartridge.

Next, a structure around the detection portion 51 of the cartridge mounting portion 5 and a structure around the detection object 180 of the tape cartridge 100 are described in detail with reference to FIGS. 7 to 9. FIG. 7 is a perspective view of the cartridge mounting portion 5, FIG. 8 is a perspective view of the lower case 150 of the tape cartridge 100, and FIG. 9 is an enlarged sectional view of portions around the detection portion 51 and the detection object 180 in a state where the tape cartridge 100 is mounted on the cartridge mounting portion 5.

As shown in the drawings, the detection portion 51 configured of the plurality of (four in the shown example) conductive contactors 51*a* (spring pieces) is provided on the positioning protrusion portion 41 (engagement projection portion) of the cartridge mounting portion 5. Meanwhile, the detection object 180 is provided on the inner peripheral portion of the core shaft portion 192 of the tape cartridge 100 with respect to the detection portion 51.

Figure 9:
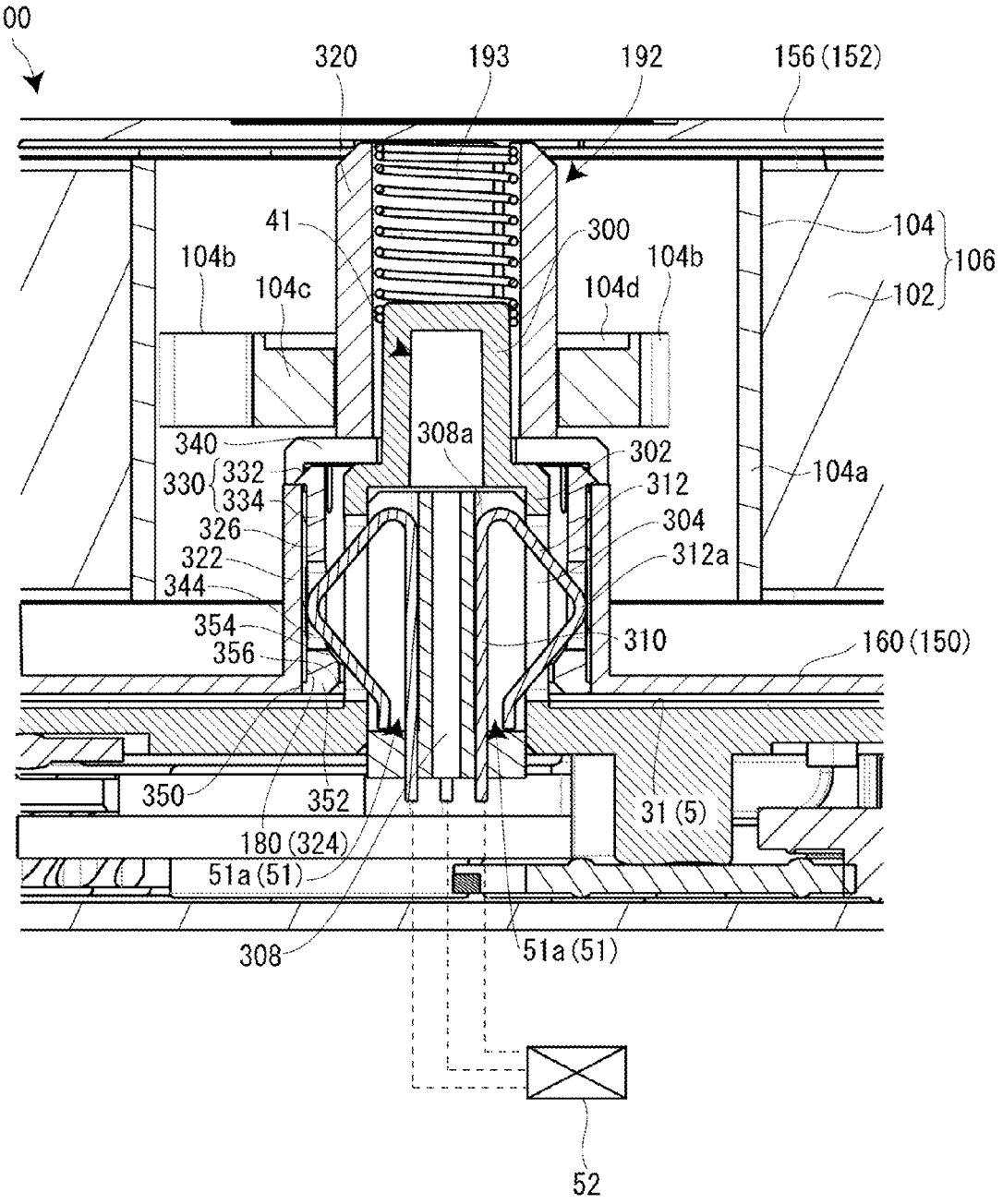
FIG. 9 is an enlarged sectional view of portions around a detection portion and a detection object in a state where the tape cartridge is mounted on the cartridge mounting portion.

As shown in FIGS. 7 and 9, the positioning protrusion portion 41 includes a first distal projection portion 300, and a second proximal projection portion 302 which is formed to have a larger diameter than that of the first projection portion 300. The first projection portion 300 and the second projection portion 302 are integrally formed (molded), and the first projection portion 300 and the second projection portion 302 are integrally formed (molded) with the mounting base 31. The first projection portion 300 is formed in a cylindrical shape having a closed upper end, and engages with a first recessed portion 320 of the core shaft portion 192 described below in a state where the tape cartridge 100 is mounted on the cartridge mounting portion 5. By the engagement, one end of the first projection portion 300 pushes up (compresses) the reverse rotation stopping spring 193 which comes into contact with the upper case 152 (top wall portion 156) such that the reverse rotation stop of the tape roll 106 is released.

The second projection portion 302 is cylindrically formed, and is loosely fitted to (engages with) a second recessed portion 322 of the core shaft portion 192 described below in a state where the tape cartridge 100 is mounted on the cartridge mounting portion 5. The detection portion 51 configured of four conductive contactors 51*a* is incorporated into the second projection portion 302. Four slit openings 304 (openings) which are equally disposed in the peripheral direction are formed on the second projection portion 302. Each slit opening 304 extends in the axial direction, and the four conductive contacts 51*a* protrude to the outside in the radial direction from the four slit openings 304.

Figure 10:
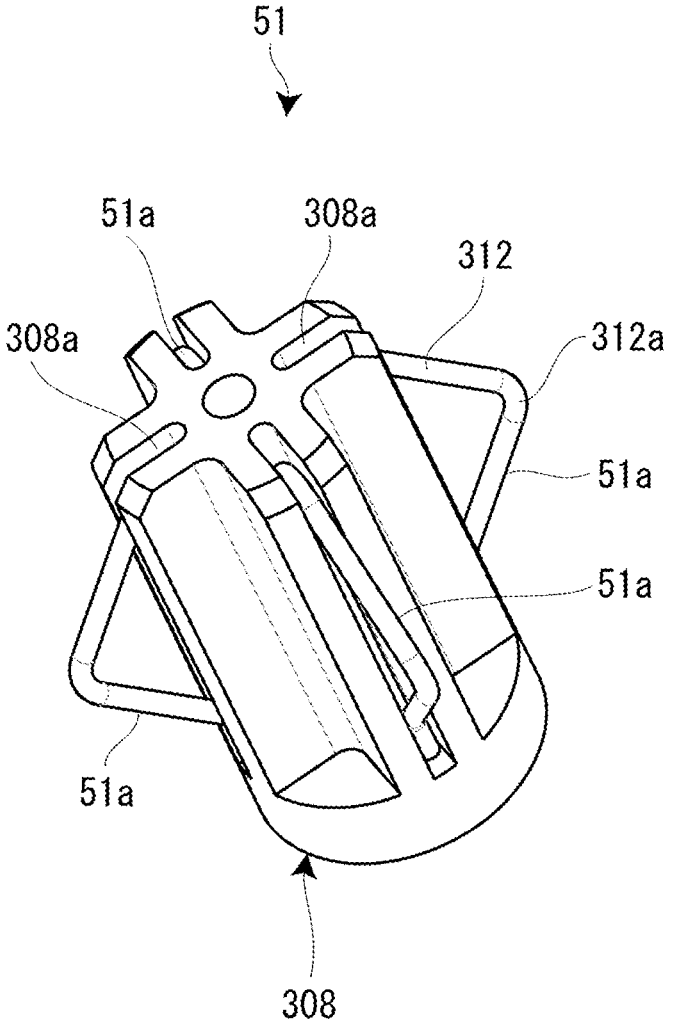
FIG. 10 is a perspective view of an insulating holder and conductive contactors which are held by the insulating holder.

As shown in FIGS. 9 and 10, the four conductive contactors 51*a* are held by an insulating holder 308 (spring holder) mounted so as to be fitted into the inner portion of the second projection portion 302 in a state of being radially disposed (equally disposed in the peripheral direction). In the insulating holder 308, four holding grooves 308*a* are formed so as to be equally disposed in the peripheral direction. Each holding groove 308*a* extends in the axial direction, and the four conductive contactors 51*a* are held by the four holding grooves 308*a*. That is, the four conductive contactors 51*a* are equally disposed in the peripheral directions of the insulating holder 308 and the second projection portion 302.

Each conductive contactor 51*a* is configured of a conductive metal wire having spring properties, and includes a linear portion 310 (held spring portion) which is fixed to the base portion of the insulating holder 308 and extends along the holding groove 308*a*, and a contactor main body 312 (bent spring portion) which is bent from the upper end of the linear portion 310 and extends in an elbow shape. The contactor main body 312 is bent, and a bent apex portion 312*a* comes into contact with a contact terminal 370 of the detection object 180 described below. The linear portion 310 is connected to the detection circuit 52 which detects the attribute information of the binarized tape cartridge 100 (refer to FIG. 9).

In the state where the tape cartridge 100 is mounted on the cartridge mounting portion 5, the conductive contactors 51*a* and the detection object 180 are positioned to face each other, the conductive contactors 51*a* exert spring forces toward the detection object 180, and the conductive contactors 51*a* and the detection object 180 elastically engage with each other. In the four conductive contactors 51*a*, two conductive contactors are disposed at symmetrical positions, and two other conductive contactors are disposed at symmetrical positions. Accordingly, in the detection object 180 which receives the spring forces, the spring forces of the four conductive contactors 51*a* are antagonistic to each other and cancelled out from each other. Therefore, the tape cartridge 100 receives the spring forces of the conductive contactors 51*a* via the detection object 180. However, positional deviation of the tape cartridge does not occur.

Each of the conductive contactors 51*a* may be a band-shaped metal material having spring properties. The spring forces of the conductive contactors 51*a* also provide a function which fixes (positions) the tape cartridge 100 to the core shaft portion 192. By fixing the core shaft portion 192 which is the center of gravity of the tape core 104 around which the print tape 102 having the greatest weight of components such as the print tape 102 or the ink ribbon 110 accommodated in the tape cartridge 100 is wound, it is possible to effectively decrease positional deviation of the tape cartridge 100 during printing.

As shown in FIGS. 8 and 9, the core shaft portion 192 of the tape cartridge 100 includes the first distal (the rear side in the engagement direction) recessed portion 320 corresponding to the first projection portion 300, and the second proximal (the front side in the engagement direction) recessed portion 322 corresponding to the second projection portion 302. The first recessed portion 320 and the second recessed portion 322 are integrally formed (molded), and the first recessed portion 320 and the second recessed portion 322 are integrally formed (molded) with the lower case 150 (bottom wall portion 160). The second recessed portion 322 is formed to have a larger diameter than that of the first recessed portion 320.

The first recessed portion 320 is cylindrically formed, and the tape core 104 rotatably engages with the outer peripheral portion of the base portion side thereof. The upper end of the first recessed portion 320 reaches the vicinity of the upper case 152 (top wall portion 156), and the reverse rotation stopping spring 193 is input into the inner peripheral portion of the first recessed portion 320 so as to be set (refer to FIG. 9). In the state where the tape cartridge 100 is mounted on the cartridge mounting portion 5, the first projection portion 300 engages with the inner peripheral portion of the base portion side of the first recessed portion 320.

The second recessed portion 322 is cylindrically formed, and the detection object 180 configured of the wiring pattern substrate 324 and a substrate cover 326 covering the wiring pattern substrate 324 are incorporated into the inner peripheral portion of the second recessed portion 322 (refer to FIG. 9). In this case, the wiring pattern substrate 324 is disposed to be disposed between the outer peripheral surface of the substrate cover 326 and the inner peripheral surface of the second recessed portion 322. The substrate cover 326 is mounted on the second recessed portion 322 in a snap-in type.

As shown in FIGS. 9 and 11, the substrate cover 326 is cylindrically formed, and four hooks 330 for snap-in are formed on the distal portion of the substrate cover 326. The four hooks 330 are disposed at equal intervals therebetween in the peripheral direction. In each hook 330, a hook body 332 protruding outward and a hook spring portion 334 which supports the hook body 332 are integrally formed. The hook spring portion 334 is formed of two cut-out portions 336 which are formed to be cut from the distal portion of the substrate cover 326.

Meanwhile, four hook receiving holes 340 (hook receiving portions) are formed on the distal portion (the end portion on the first recessed portion 320 side) of the second recessed portion 322 so as to correspond to the four hooks 330 (refer to FIG. 8). Each hook receiving hole 340 is formed to have approximately the same width as that of each hook 330, and can position each hook 330 in the peripheral direction. If the substrate cover 326 is inserted into the second recessed portion 322 in the state where the four hooks 330 are positioned at the four hook receiving holes 340, each hook spring portion 334 is bent, and each hook 330 is locked (snapped-in) so as to be fallen into the hook receiving hole 340. Accordingly, the substrate cover 326 is mounted on the second recessed portion 322 in a locked state.

Four through holes 344 corresponding to the conductive contactors 51*a* are formed on the substrate cover 326. Each through hole 344 is formed in a slit shape, and extends in the axial direction. Each through hole 344 is positioned at the intermediate portion in the vertical direction of the substrate cover 326 in the axial direction and is disposed at the same position as the position of each hook 330 in the peripheral direction. In the conductive contactor 51*a* which faces the through hole 344, the bent apex portion 312*a* comes into contact with each contact terminal 370 of the wiring pattern substrate 324 described below (refer to FIG. 9).

When the tape cartridge 100 is mounted on the cartridge mounting portion 5, the positions of the four conductive contactors 51*a* on the cartridge mounting portion 5 side and the positions of the four contact terminals 370 on the tape cartridge 100 side are required so as to be always matched to each other in the peripheral direction. Similarly, the four conductive contactors 51*a* and the four through holes 344 are required so as to be matched with each other in the peripheral direction. Accordingly, the positions of the four hooks 330 of the substrate cover 326 in the peripheral direction are regulated with respect to the four hook receiving holes 340 of the second recessed portion 322.

Accordingly, in the present embodiment, the four conductive contactors 51*a*, the four through holes 344, the four hooks 330, and the four hook receiving holes 340 are disposed such that the positions thereof are matched with each other. Although the details will be described below, the four contact terminals 370 are disposed based on the positions of the four hooks 330 or the four hook receiving holes 340 (refer to FIG. 11B).

The wiring pattern substrate 324 may be partially bonded to the outer peripheral surface of the substrate cover 326 by an adhesive or the like. In this case, a rear adhesive layer is not required, and the wiring pattern substrate 324 can be simply mounted on the second recessed portion 322 along with the substrate cover 326.

As shown in FIGS. 9 and 11, a fitting protrusion portion 350 which annularly protrudes outwardly on the outer peripheral surface of the substrate cover 326, and an annular protrusion portion 352 which annularly protrudes inwardly on the inner peripheral surface thereof are provided on the base portion (the shown lower side) of the substrate cover 326. The lower end (the shown lower side) of the wiring pattern substrate 324 which is disposed outside the substrate cover 326 comes into contact with the fitting protrusion portion 350. The fitting protrusion portion 350 is fitted to the base end portion of the second recessed portion 322 in the state where the substrate cover 326 is mounted on the second recessed portion 322. Meanwhile, the protrusion dimension of the fitting protrusion portion 350 corresponds to the thickness of the wiring pattern substrate 324. Accordingly, in a state where the lower end of the wiring pattern substrate 324 comes into contact with (is positioned at) the fitting protrusion portion 350, the wiring pattern substrate 324 enters a minute gap between the second recessed portion 322 and the substrate cover 326 generated by the fitting protrusion portion 350.

When the tape cartridge 100 is mounted on the cartridge mounting portion 5, the four conductive contactors 51*a* relatively override the annular protrusion portion 352 while being elastically deformed. In this case, the distal side and the proximal side of the annular protrusion portion 352 are formed so as to be chamfered. That is, an annular distal inclined surface 354 is formed on the distal side of the annular protrusion portion 352, and an annular proximal inclined surface 356 is formed on the proximal side thereof.

When each conductive contactor 51*a* relatively overrides the proximal inclined surface 356, the conductive contactor 51*a* is smoothly deformed elastically by the proximal inclined surface 356. The distal inclined surface 354 provides click feeling when the tape cartridge 100 is mounted, and prevents floating of the mounted tape cartridge 100 using the spring force of each conductive contactor 51*a*.

Figure 11A:
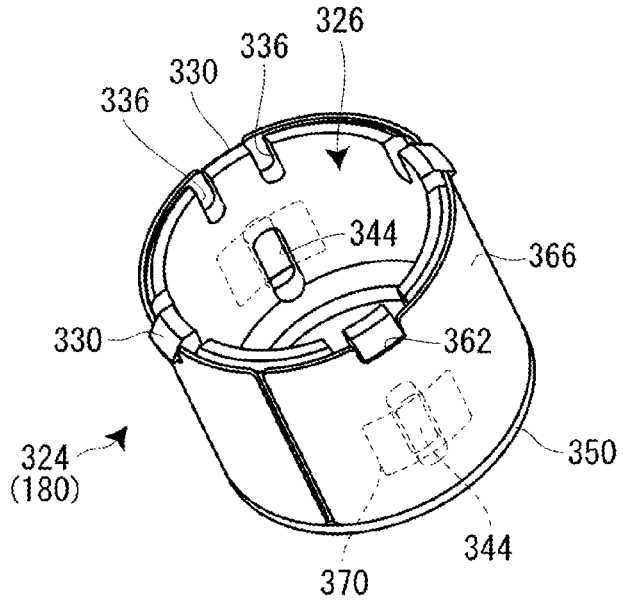
FIG. 11A is a perspective view of a wiring pattern substrate and a substrate cover.
Figure 11B:
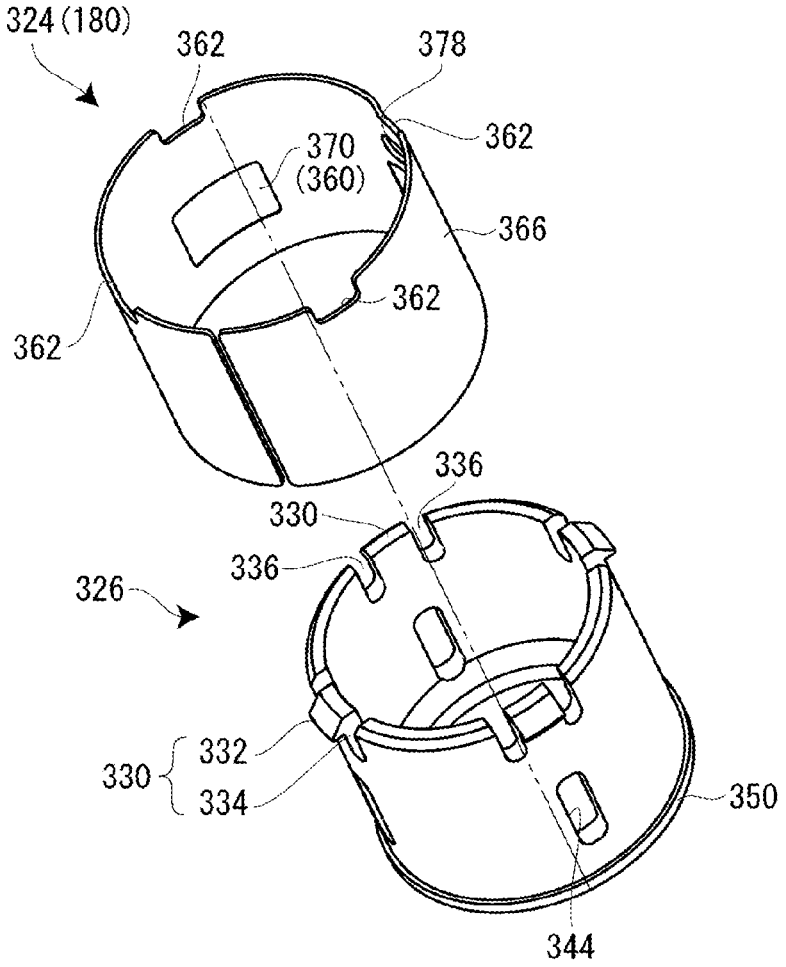
FIG. 11B is an exploded perspective view thereof.
Figure 12A:
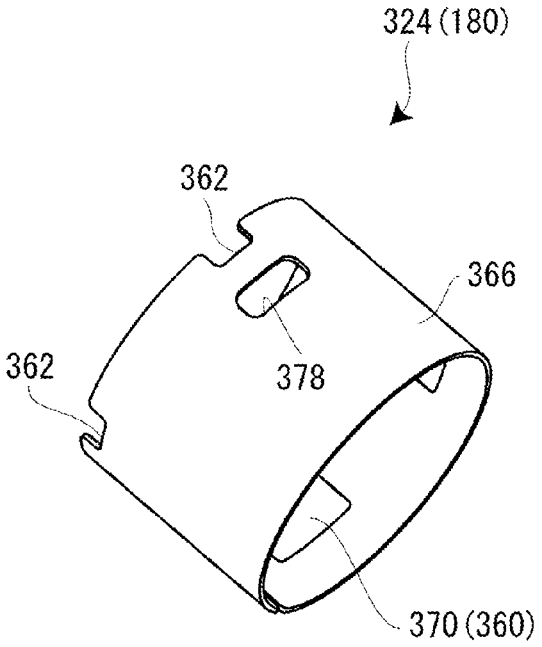
FIG. 12A is a perspective view of the wiring pattern substrate.
Figure 12B:
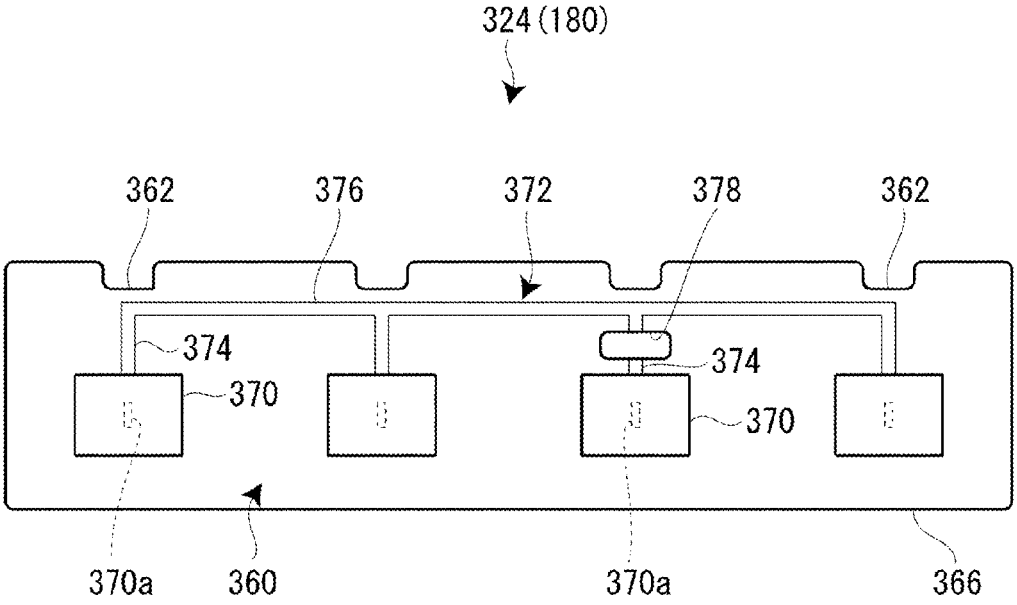
FIG. 12B is a plan view of a deployed state thereof.

As shown in FIGS. 9, 11, and 12, the wiring pattern substrate 324 is configured of a Flexible Printed Circuit (FPC) or the like, and is attached to the inner peripheral surface of the second recessed portion 322. In the deployed wiring pattern substrate 324, a wiring pattern 360 is formed on the front side, and an adhesive layer (not shown) is provided on the rear side (refer to FIG. 12B). Accordingly, the wiring pattern substrate 324 is cylindrically bent such that the front side faces the inside and the rear side faces the outside, and is bonded to the inner peripheral surface of the second recessed portion 322. In actual bonding between the wiring pattern substrate 324 and the second recessed portion 322, the wiring pattern substrate 324 is wound around the outer peripheral surface of the substrate cover 326, and is mounted on and bonded to the second recessed portion 322 along with the substrate cover 326.

The wiring pattern substrate 324 is formed such that the length thereof is slightly shorter than the peripheral length on the inner peripheral surface of the second recessed portion 322, and the end portions of the wiring pattern substrate 324 bonded to the second recessed portion 322 do not overlap each other (refer to FIG. 11A). In the wiring pattern substrate 324, four notched recess portions 362 are formed on the portions corresponding to the four hook receiving holes 340 of the second recessed portion 322, that is, the portions corresponding to the four hooks 330 of the substrate cover 326.

The four notched recess portions 362 are provided such that the four hooks 330 escape, and also function as reference positions for patterning the wiring pattern 360. Although the details will be described below, the four contact terminals 370 of the wiring pattern 360 are patterned so as to be matched with the positions of the four hooks 330 (four notched recess portions 362) in the peripheral direction (refer to FIG. 12B).

The wiring pattern substrate 324 may be a wiring pattern substrate in which the conductive wiring pattern 360 and the conductive contact terminal 370 are flexibly provided on a base material such as a wiring pattern substrate in which the wiring pattern 360 is printed on a sheet material such as a paper sheet or a resin film instead of the FPC using conductive ink, a wiring pattern substrate in which the wiring pattern 360 is metallic vapor-deposited on a sheet material, or a wiring pattern substrate in which the wiring pattern 360 remains on a metal foil and an insulating ink material is printed.

As shown in FIGS. 12A and 12B, in the wiring pattern substrate 324 which configures the detection object 180, the wiring pattern 360 which configures the attribute information of the tape cartridge 100 is formed on a base substrate 366. The wiring pattern 360 includes the four contact terminals 370 which include contact portions 370*a* with which the four conductive contactors 51*a* come into contact, and a conduction/non-conduction wiring portion 372 which is connected to the four contact terminals 370. The conduction/non-conduction wiring portion 372 includes four individual wiring portions 374 which are connected to the contact terminals 370, and a common wiring portion 376 to which the four individual wiring portions 374 are connected, and the attribute information of the tape cartridge 100 is configured by performing conduction/non-conduction on the four individual wiring portions 374.

Each contact terminal 370 and each individual wiring portion 374 are provided at the same position as that of the notched recess portion 362 in the peripheral direction. Each contact terminal 370 is patterned in a wide and rectangular shape at the position matched with that of the through hole 344 of the substrate cover 326.

In this case, the four individual wiring portions 374 configure bit patterns of $2^4=16$ by conduction/non-conduction, that is, configure 16 kinds of attribute information. However, in a case where the mounting of the tape cartridge 100 is detected by the detection portion 51 and the detection object 180, when all the four individual wiring portions 374 are non-conduction patterns, since the mounting of the tape cartridge 100 cannot be detected, the kinds of actual attribute information become $2^4-1=15$. In addition, in a case where means for detecting the mounting of the tape cartridge 100 is provided, each of 16 kinds of attribute information can be allocated to each bit pattern.

Meanwhile, the non-conduction of the embodiment is configured by removing a portion of desired individual wiring portions 374 with respect to the four patterned individual wiring portions 374. That is, in the wiring pattern 360 (wiring pattern substrate 324) as an original, the four individual wiring portions 374 are connected to the four contact terminals 370 and the state becomes a conduction state. In the original, for example, a punched hole 378 is formed on the base substrate 366 by laser processing or punching, and a portion of the individual wiring portions 374 becomes a non-conduction state.

In the detection circuit 52 which is connected to the four conductive contactors 51*a*, any one of 15 kinds of bit patterns (attribute information) is detected, and the kind of the tape cartridge 100 is detected.

Modification Example of Detection Object

Figure 13A:
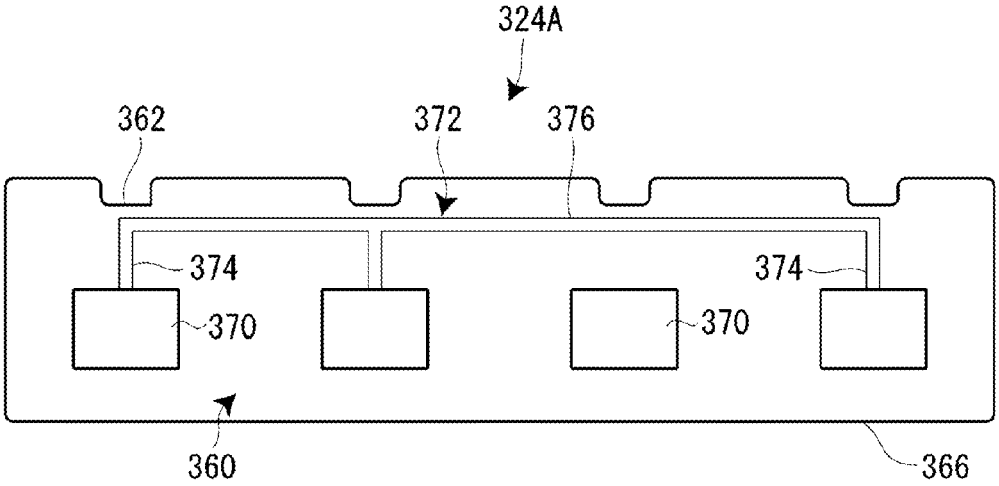
FIG. 13A is a plan view of a deployed state of a wiring pattern substrate according to a first modification example.

Next, a modification example of the wiring pattern substrate 324 (detection object 180) is described with reference to FIGS. 13A and 13B. FIG. 13A is a plan view of a wiring pattern substrate 324A according to a first modification example, FIG. 13B is a plan view of a wiring pattern substrate 324B according to a second modification example, and FIG. 13C is a plan view of a wiring pattern substrate 324C according to a third modification example.

As shown in FIG. 13A, in the wiring pattern substrate 324A of the first modification example, the wiring pattern 360 is provided in which a desired individual wiring portion 374 among the four individual wiring portions 374 is not present. That is, the plurality of kinds of wiring pattern substrates 324A having wiring patterns 360 different from each other are provided corresponding to the kinds (15 kinds) of the tape cartridges 100. A configuration may be provided in which necessary leads are soldered using leads (lead wires) corresponding to the individual wiring portions 374.

Figure 13B:
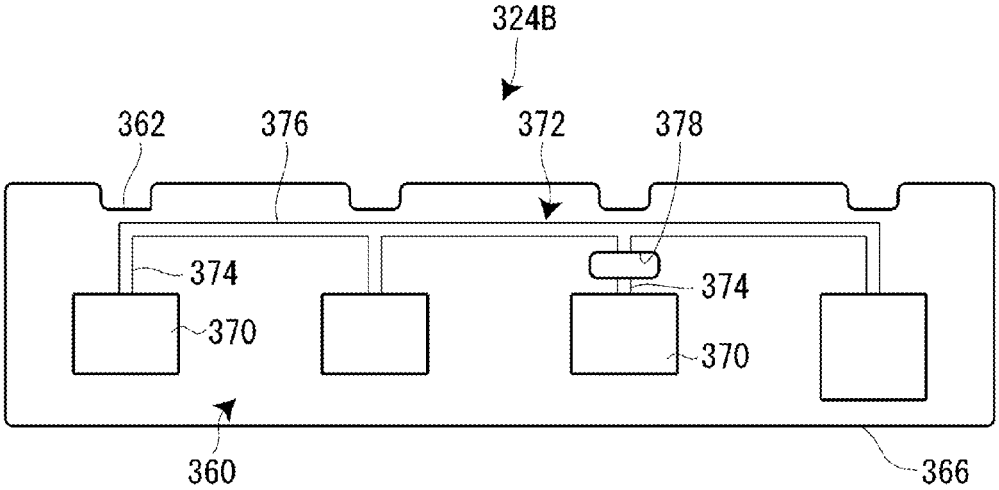
FIG. 13B is a plan view of a deployed state of a wiring pattern substrate according to a second modification example.

As shown in FIG. 13B, in the wiring pattern substrate 324B of the second modification example, the four individual wiring portions 374 and the common wiring portion 376 are configured of resistor wires. In this case, 15 kinds of bit patterns (the attribute information of the tape cartridge 100) can be detected by differences between resistance values (current values).

Figure 13C:
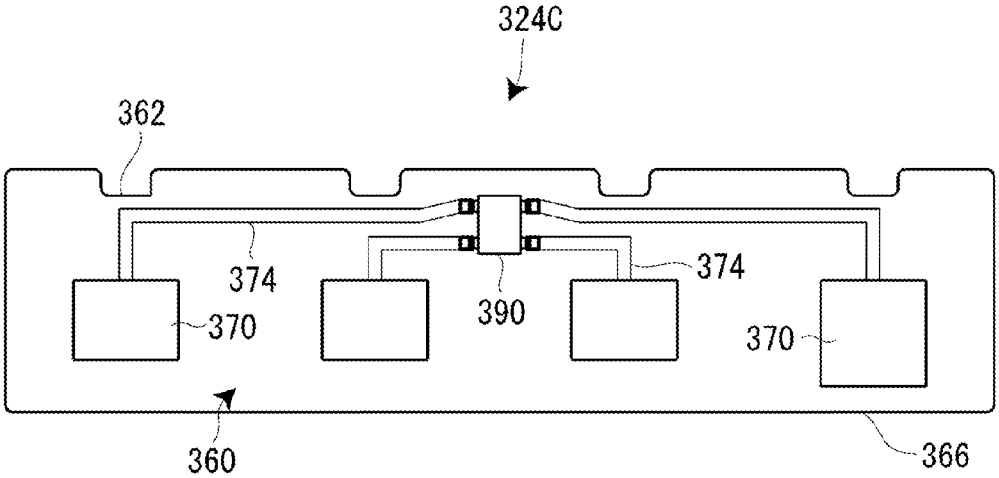
FIG. 13C is a plan view of a deployed state of a wiring pattern substrate according to a third modification example.

As shown in FIG. 13C, in the wiring pattern substrate 324C of the third modification example, an electronic device 390 (IC chip) is disposed in the wiring pattern 360 on the wiring pattern substrate 324C. In this modification example, the common wiring portion 376 is not present, and each of the individual wiring portions 374 is connected to the electronic device 390. The attribute information for each kind in the tape cartridges 100 is stored in the electronic device 390. The detection circuit 52 reads the attribute information of the electronic device 390 and detects the kind of the tape cartridge 100.

Particularly, in the third modification example, two individual wiring portions 374 are set to power lines (a drive voltage supply line and a ground line of the electronic device 390), and two other individual wiring portions 374 are set to signal lines for sending and receiving. Accordingly, in a case where EEPROM, a flash memory, or the like is used as the electronic device 390, it is possible not only to read the attribute information but also to write necessary information. For example, it is possible to overwrite a remaining tape amount or the like of the print tape 102 from the tape printing apparatus 1 side.

As described above, according to the present embodiment, since a relatively large diameter is provided in view of preventing peculiar winding of the print tape 102 and the detection object 180 (wiring pattern substrate 324) is incorporated into the inner peripheral portion of the core shaft portion 192 which is a dead space, it is possible to decrease a size of the tape cartridge 100. It is possible to relatively increase the area of the wiring pattern substrate 324. Accordingly, even when minute positional deviation occurs in the tape cartridge 100 which is mounted on the cartridge mounting portion 5, it is possible to stably perform the detection of the attribute information of the tape cartridge 100 without decreasing detection performance of the detection portion 51. In a case where the electronic device 390 is used, it is possible to have attribute information of larger capacity in the tape cartridge 100.

Needless to say, the number of the conductive contactors 51*a*, or the number of the contact terminals corresponding to the conductive contactors 51*a* may be arbitrarily selected.

Second Embodiment

Next, as a second embodiment, an embodiment in which the conductive contactors 51*a* are used as simple spring pieces is described. In the second embodiment, portions different from those of the first embodiment are mainly described. In this embodiment, a tape detection portion (not shown) corresponding to the detection portion 51 is provided in the vicinity of the winding drive shaft 47, and a tape detection object (not shown) corresponding to the detection object 180 is provided on the tape cartridge 100 corresponding to the tape detection portion.

Figure 14B:
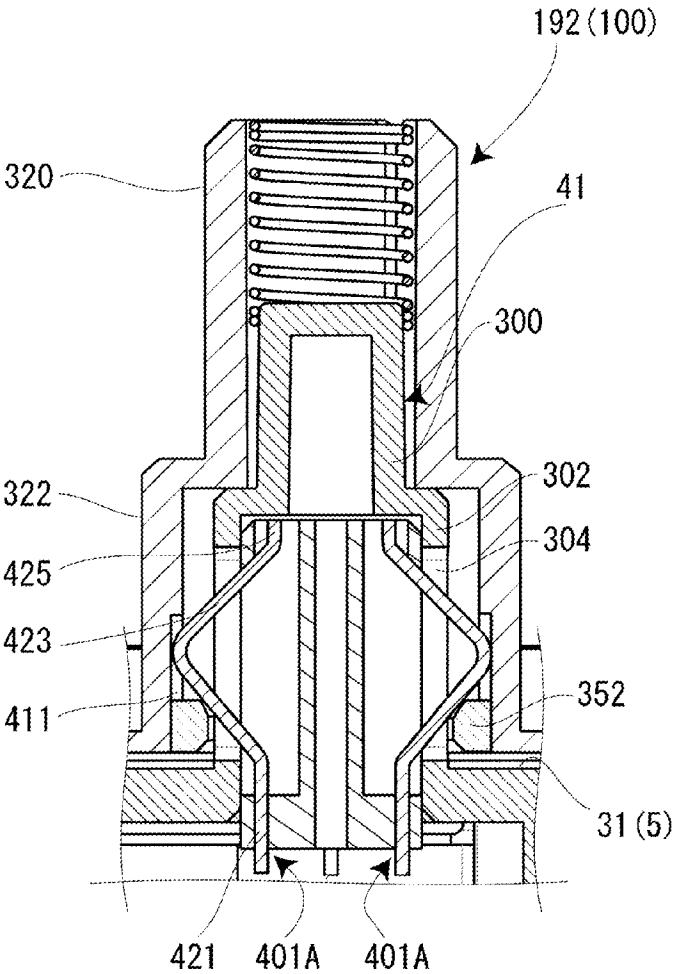
Figure 14A:
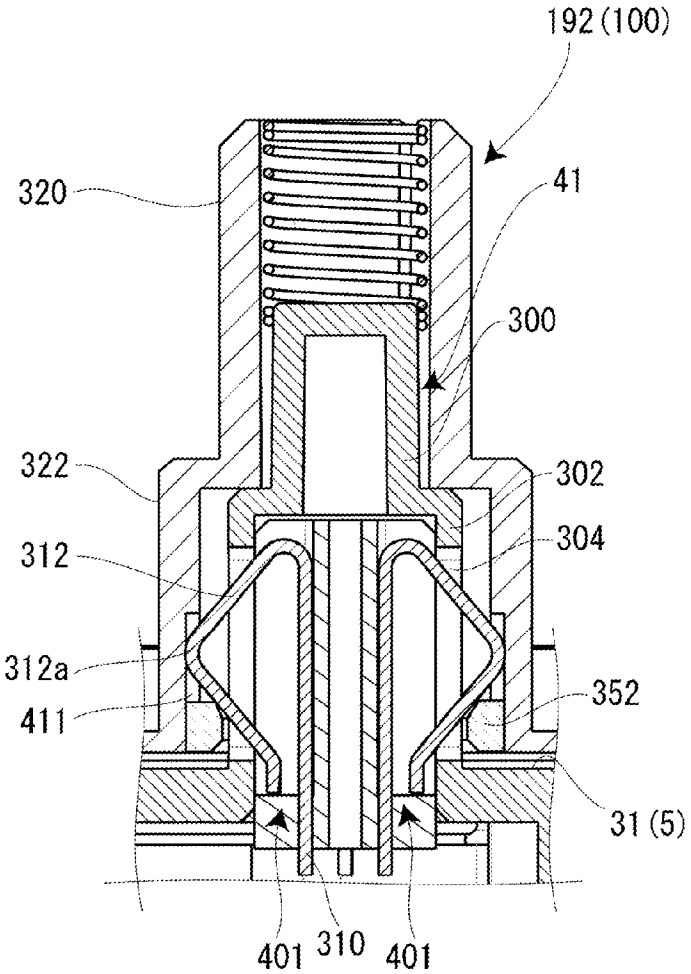

As shown in FIG. 14A, four spring pieces 401 are provided on the positioning protrusion portion 41, and the four spring pieces 401 come into direct contact with the inner peripheral surface of the core shaft portion 192. Each spring piece 401 has the same shape as that of the conductive contactor 51*a*, and similarly to the first embodiment, the spring pieces 401 are held by a spring holder 403 corresponding to the insulating holder 308. However, in this case, each of the spring pieces 401 does not need to have conductivity, and the spring holder 403 also does not need to have conductivity.

Meanwhile, four slit-shaped position regulation grooves 411 corresponding to the four spring pieces 401 are formed on the inner peripheral surface of the core shaft portion 192. The annular protrusion portion 352 similar to that of the first embodiment is provided on the inner peripheral surface of the core shaft portion 192 as a separate member. The annular protrusion portion 352 is provided on the inner peripheral surface on the base portion side of the core shaft portion 192, and the four position regulation grooves 411 are provided above the annular protrusion portion 352.

If the second recessed portion 322 of the core shaft portion 192 is fitted to the second projection portion 302 of the positioning protrusion portion 41 according to the mounting of the tape cartridge 100 on the cartridge mounting portion 5, the four spring pieces 401 relatively override the annular protrusion portion 352 while being elastically deformed with respect to the annular protrusion portion 352. The four spring pieces 401 overriding the annular protrusion portion 352 instantly engages with the position regulation grooves 411. That is, when the tape cartridge 100 is mounted, the four spring pieces 401 engage with the position regulation grooves 411 in a click manner.

Each spring piece 401 which has engaged with the position regulation groove 411 comes into contact with the groove bottom of the position regulation groove 411, and the four spring pieces 401 bias the core shaft portion 192 (second recessed portion 322) toward the outside in the radial direction via the groove bottom. Each spring piece 401 comes into contact with the annular protrusion portion 352, and prevents floating of the tape cartridge 100 via the annular protrusion portion 352.

FIG. 14B is a modification example of the second embodiment. In this case, each spring piece 401A is formed by bending a wire having spring properties. Each spring piece 401A includes a held spring portion 421 which is fixed to the base portion of the spring holder 403, a bent spring portion 423 which extends in an elbow shape from the upper end of the held spring portion 421 similarly to the contactor main body 312 of the first embodiment, and a free end portion 425 which extends from the upper end of the bent spring portion 423.

In this case, If the second recessed portion 322 of the core shaft portion 192 is fitted to the second projection portion 302 of the positioning protrusion portion 41 according to the mounting of the tape cartridge 100 on the cartridge mounting portion 5, the four spring pieces 401A relatively override the annular protrusion portion 352 while being elastically deformed with respect to the annular protrusion portion 352. The four spring pieces 401A overriding the annular protrusion portion 352 instantly engage with the position regulation grooves 411 respectively. That is, when the tape cartridge 100 is mounted, the four spring pieces 401A engage with the position regulation grooves 411 in a click manner.

Each spring piece 401A which has engaged with the position regulation groove 411 comes into contact with the groove bottom of the position regulation groove 411, and the four spring pieces 401A bias the core shaft portion 192 (second recessed portion 322) toward the outside in the radial direction via the groove bottom. Each spring piece 401A comes into contact with the annular protrusion portion 352, and prevents floating of the tape cartridge 100 via the annular protrusion portion 352.

In this way, according to the configuration of the second embodiment, when the tape cartridge 100 is attached and detached, the spring pieces 401 and 401A guide the tape cartridge 100 while being appropriately bent (deformed elastically). Accordingly, minute positional deviation or minute inclination of the tape cartridge 100 is absorbed, and attachment and detachment of the tape cartridge 100 are smoothly performed. According to the respective four spring pieces 401 and 401A, the tape cartridge 100 is positioned at a predetermined position at which the spring forces of the respective four spring pieces 401 and 401A are antagonistic to each other (are cancelled out from each other). Accordingly, it is possible to obtain both smoothness of attachment and detachment and appropriate positioning accuracy with respect to the tape cartridge 100.

Third Embodiment

Next, a third embodiment is described with reference to FIG. 15. In the third embodiment, portions different from those of the second embodiment are mainly described.

Figure 15:
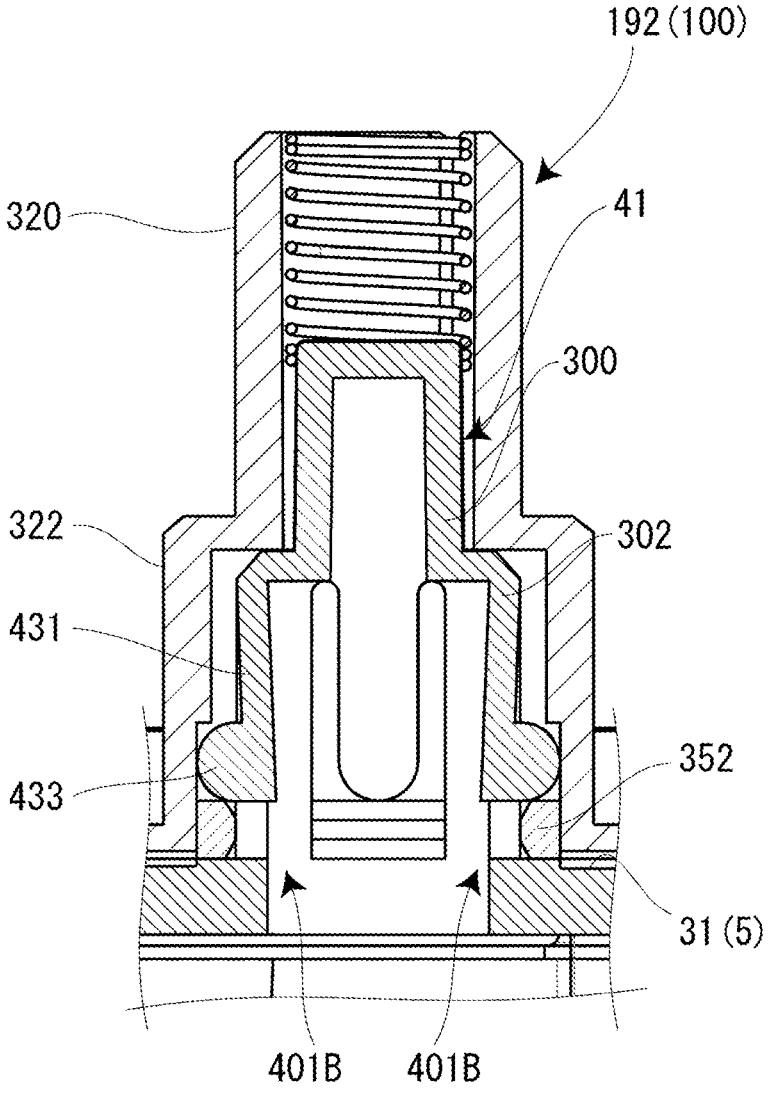
FIG. 15 is an enlarged sectional view around a positioning protrusion portion of a third embodiment.

As shown in FIG. 15, in the third embodiment, the positioning protrusion portion 41 (second projection portion 302) and a plurality of (four) spring pieces 401B are integrally formed. That is, the four spring pieces 401B are formed by partially removing the peripheral wall in a "U" shape at four locations of the second projection portion 302 in the peripheral direction. Each spring piece 401B includes a plate-shaped spring portion 431 which is suspended from the shoulder portion of the second projection portion 302, and a hemispherical protrusion 433 which protrudes from the outer surface of the lower end portion of the plate-shaped spring portion 431.

In this case, if the second recessed portion 322 of the core shaft portion 192 is fitted to the second projection portion 302 of the positioning protrusion portion 41, the four spring pieces 401B relatively override the annular protrusion portion 352 while being elastically deformed with respect to the annular protrusion portion 352, and engage with the position regulation groove 411. That is, when the tape cartridge 100 is mounted, the four spring grooves 401B engage with the position regulation grooves 411 in a click manner.

Each spring piece 401B which has engaged with the position regulation groove 411 comes into contact with the groove bottom of the position regulation groove 411, and the four spring pieces 401B bias the core shaft portion 192 (second recessed portion 322) toward the outside in the radial direction via the groove bottom. Each spring piece 401B comes into contact with the annular protrusion portion 352, and prevents floating of the tape cartridge 100 via the annular protrusion portion 352.

In this way, according to the configuration of the third embodiment, similarly to the second embodiment, minute positional deviation or minute inclination of the tape cartridge 100 is absorbed by the four spring pieces 401B when the tape cartridge 100 is mounted, and attachment and detachment of the tape cartridge 100 are smoothly performed. According to the four spring pieces 401B, the tape cartridge 100 is positioned at a predetermined position at which the spring forces of the four spring pieces 401B are antagonistic to each other (are cancelled out from each other). Accordingly, it is possible to obtain both smoothness of attachment and detachment and appropriate positioning accuracy with respect to the tape cartridge 100.

In the second embodiment and the third embodiment, the number of the respective spring pieces 401, 401A, and 401B is arbitrarily (two or more) selected.

The invention claimed is:

1. A tape printing apparatus, comprising:

a cartridge mounting portion on which a tape cartridge having a core shaft portion disposed on an inner peripheral side of a wound print tape is detachably mounted;

an engagement projection portion which protrudes from the cartridge mounting portion and engages with an inner peripheral portion of the core shaft portion of the mounted tape cartridge;

a plurality of spring pieces which are provided in the engagement projection portion; and a spring holder which holds the plurality of spring pieces, wherein the plurality of spring pieces are equally disposed in a peripheral direction in the engagement projection portion, and bias an inner peripheral surface of the engaged core shaft portion toward the outside in a radial direction, the spring holder is disposed inside the engagement projection portion, and the plurality of spring pieces protrude outward from a plurality of openings which are formed in the engagement projection portion.

2. The tape printing apparatus according to claim 1, wherein a mounting base portion configuring the cartridge mounting portion and the engagement projection portion are integrally formed.

3. The tape printing apparatus according to claim 1, wherein the inner peripheral portion of the core shaft portion includes a first recessed portion on the rear side in the engagement direction, and a second recessed portion which is formed to have a larger diameter than that of the first recessed portion and is positioned on the front side in the engagement direction, wherein the engagement projection portion includes a first distal projection portion which engages with the first recessed portion and a second proximal projection portion which engages with the second recessed portion, and wherein the plurality of spring pieces are provided on the second proximal projection portion.

4. The tape printing apparatus according to claim 3, wherein a reverse rotation stopping mechanism, which engages with and disengages from a tape core of the print tape and can perform a reverse rotation stop operation and a reverse rotation stop release operation on the tape core, is incorporated into the first recessed portion, and wherein the first distal projection portion performs the release operation on the reverse rotation stopping mechanism according to mounting of the tape cartridge.

5. The tape printing apparatus according to claim 1, wherein each spring piece is formed by bending a wire having spring properties.

6. The tape printing apparatus according to claim 5, wherein each spring piece includes a held spring portion which is held by the spring holder, and a bent spring portion which extends from the held spring portion and includes an apex portion coming into contact with the inner peripheral surface of the core shaft portion.

7. The tape printing apparatus according to claim 6, wherein a plurality of through holes with which the bent spring portions of the spring pieces engage are provided on the inner peripheral surface of the core shaft portion, wherein each of the bent spring portions is formed to be bent in an elbow shape, and wherein the bent spring portion engages with the through hole while being elastically deformed according to the engagement of the core shaft portion with respect to the engagement projection portion, and comes into contact with a base end of the through hole in a state where the bent spring portion engages with the through hole.

8. The tape printing apparatus according to claim 1, further comprising:

a detection portion which comes into electric contact with a detection object which is provided on the inner peripheral portion of the core shaft portion of the mounted tape cartridge so as to be conductive with the detection object, and detects attribution information of the tape cartridge, wherein the detection portion includes the plurality of spring pieces which are configured of conductive metal wires having spring properties, and wherein the plurality of spring pieces are connected to a detection circuit which detects binarized attribution information.

9. The tape printing apparatus according to claim 8, wherein the detection object further includes:

a wiring pattern substrate in which a plurality of contact terminals including contact portions with which the plurality of spring pieces come into contact, and a conduction/non-conduction wiring portion which is connected to the plurality of contact terminals are provided; and a cylindrical substrate cover which covers the wiring pattern substrate, wherein the plurality of spring pieces come into contact with the contact terminals via a plurality of through holes which are formed on the substrate cover.

10. A tape printing system, comprising:

the tape printing apparatus according to claim 1; and the tape cartridge which is detachably mounted on the cartridge mounting portion.

11. A tape printing apparatus, comprising:

a cartridge mounting portion on which a tape cartridge having a core shaft portion disposed on an inner peripheral side of a wound print tape is detachably mounted;

an engagement projection portion which protrudes from the cartridge mounting portion and engages with an inner peripheral portion of the core shaft portion of the mounted tape cartridge; and a plurality of spring pieces which are provided in the engagement projection portion, wherein the plurality of spring pieces are equally disposed in a peripheral direction in the engagement projection portion, and bias an inner peripheral surface of the engaged core shaft portion toward the outside in a radial direction, the inner peripheral portion of the core shaft portion includes a first recessed portion on the rear side in the engagement direction, and a second recessed portion which is formed to have a larger diameter than that of the first recessed portion and is positioned on the front side in the engagement direction, the engagement projection portion includes a first distal projection portion which engages with the first recessed portion and a second proximal projection portion which engages with the second recessed portion, the plurality of spring pieces are provided on the second proximal projection portion, a reverse rotation stopping mechanism, which engages with and disengages from a tape core of the print tape and can perform a reverse rotation stop operation and a reverse rotation stop release operation on the tape core, is incorporated into the first recessed portion, and the first distal projection portion performs the release operation on the reverse rotation stopping mechanism according to mounting of the tape cartridge.

12. A tape printing apparatus, comprising:

a cartridge mounting portion on which a tape cartridge having a core shaft portion disposed on an inner peripheral side of a wound print tape is detachably mounted;

an engagement projection portion which protrudes from the cartridge mounting portion and engages with an inner peripheral portion of the core shaft portion of the mounted tape cartridge;

a plurality of spring pieces which are provided in the engagement projection portion; and a detection portion which comes into electric contact with a detection object which is provided on an inner peripheral portion of the core shaft portion of the mounted tape cartridge so as to be conductive with the detection object, and detects attribution information of the tape cartridge, wherein the plurality of spring pieces are equally disposed in a peripheral direction in the engagement projection portion, and bias the inner peripheral surface of the engaged core shaft portion toward the outside in a radial direction, the detection portion includes the plurality of spring pieces which are configured of conductive metal wires having spring properties, and the plurality of spring pieces are connected to a detection circuit which detects binarized attribution information.

* * * * *